US007909620B2

(12) United States Patent
Masaki et al.

(10) Patent No.: US 7,909,620 B2
(45) Date of Patent: Mar. 22, 2011

(54) SOCKET CONTACT

(75) Inventors: Katsuyuki Masaki, Kanagawa (JP); Masaki Kishimoto, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 244 days.

(21) Appl. No.: 12/382,318

(22) Filed: Mar. 13, 2009

(65) Prior Publication Data

US 2009/0239397 A1 Sep. 24, 2009

(30) Foreign Application Priority Data

Mar. 18, 2008 (JP) ..... 2008-069080

(51) Int. Cl.
*H01R 12/00* (2006.01)

(52) U.S. Cl. ..... 439/81

(58) Field of Classification Search ..... 439/77, 439/81, 849–851, 856–857
See application file for complete search history.

(56) References Cited

U.S. PATENT DOCUMENTS 6,814,598 B2 * 11/2004 Hoffmann et al. ..... 439/249
7,393,216 B2 * 7/2008 Masaki et al. ..... 439/81

FOREIGN PATENT DOCUMENTS

JP 05-049202 A 2/1993
JP 05-056599 A 3/1993
JP 05-115148 A 5/1993
JP 05-328652 A 12/1993
JP 07-213002 A 8/1995
JP 09-093857 A 4/1997
JP 10-191609 A 7/1998
JP 2001-112211 A 4/2001
JP 2001-145298 A 5/2001
JP 2002-034981 A 2/2002
JP 2002-100440 A 4/2002
JP 2004-229378 A 8/2004
JP 2005-317262 A 11/2005
JP 2008-017635 A 1/2008

* cited by examiner

*Primary Examiner* — Edwin A. Leon
*Assistant Examiner* — Vanessa Girardi
(74) *Attorney, Agent, or Firm* — Rader, Fishman & Grauer PLLC

(57) ABSTRACT

A low-profile socket contact is provided that is mountable on a print substrate and has a high contact pressure. The socket contact includes a base portion provided on a print substrate, and a contact connecting portion connecting to the tab-shaped contact provided on a central portion of the base portion. The base portion has an opening in which the tab-shaped contact passes through, and a plurality of lead portions solderable to the print substrate. The contact connecting portion has a pair of first bending fragments, a pair of first inverted arms, a pair of second bending fragments, and a pair of second inverted arms. A contact point in contact with the tab-shaped contact is provided on each front ends of the pair of first inverted arms, and a guiding face in which the tab-shaped contact slides is provided on the pair of second inverted arms.

15 Claims, 14 Drawing Sheets

SOCKET CONTACT

This application is based on and claims the benefit of priority from Japanese Patent Application No. 2008-069080, filed on 18 Mar. 2008, the content of which is incorporated herein by reference in its entirety.

BACKGROUND OF THE INVENTION

1. Field of the Invention

The present invention relates to a socket contact. In particular, it relates to a structure of a socket contact, which elastically connects to an extremely small tabular tab-shaped contact, and is capable of being provided in a print substrate.

2. Related Art

In compact electronic equipment for photographic use of recent years, small-size motors are embedded. Generally, these kinds of small-size motors include a pair of tabular tab-shaped contacts (hereinafter, called "input terminals"). In addition, by supplying electricity to these input terminals, it is possible to drive the small-size motors.

For example, in input terminals of small-size motors such as the above, terminals of the wires thereof are connected by soldering. Moreover, input terminals are inserted into through holes provided on a rigid substrate or a flexible substrate, and the input terminals are joined by soldering to these through holes. In compact electronic equipment for photographic use, many multi-branched foldable flexible substrates are used, and these flexible substrates connect small-size motors and other internal electric and electronic elements.

Automating direct soldering of input terminals of small-size motors to flexible substrates is difficult. The reason is that, if a small-size motor and a flexible substrate are put into a reflow furnace capable of automatic soldering, the small-size motor is heated. In the end, there was no alternative but to rely on soldering by way of skilled manual labor. In addition, this hindered increase of productivity.

In response to these circumstances, small-size motors which are quickly connectable to flexible substrates, are versatile, and allow for cost reduction have been invented (for example, see Japanese Unexamined Patent Application Publication No. H5-115148 (hereinafter referred to as "Patent Publication 1")).

FIG. 23 is an exploded perspective assembly view of main parts showing an embodiment of a small-size motor according to Patent Publication 1. FIG. 23 of the present application corresponds to FIG. 2 of Patent Publication 1. In FIG. 23, a small-size motor 80 has a case 81 formed in a shape of a bottomed hollow tube. In the case 81, a rotor consisting of an armature and a commutator not shown is internally packaged. An end plate 82 with insulation properties is attached to a rear-end portion of the case 81.

In FIG. 23, ends of a pair of brush arms (not shown) electrically connecting to be slidable to a commutator protrude from an end plate 82 as an input terminal 83. Moreover, a columnar bearing 84 supporting one end of the rotor to be rotatable bulges from the end plate 82. On a circumference of the bearing 84, a toric protrusion 84*a* is elevated.

In FIG. 23, a connector unit 90 is constructed of a substantially discoid housing 91 and a pair of strip-shaped contacts 92 and 92 fixed to the housing 91 and making a substantially circular arc. In the housing 91, an opening 91*a*, into which a print substrate (not shown) can be inserted, is formed. Moreover, in the center of the housing 91, a circular hole 91*b* engaging the bearing 84 is formed. On the left and right flanks of the hole 91*b*, a pair of rectangular insertion holes 91*c* and 91*c* are provided.

In FIG. 23, the contact 92 has, on a side of one end, clamping fragments 92*a* inserted into the engaging hole (not shown) in communication with the opening 91*a* formed by way of bending, and has, on a side of another end, contact fragments 92*c* inserted into the insertion holes 91*c* formed by way of bending. When the connector unit 90 built up by a pair of contacts 92 and 92 on the housing 91 is attached to the end plate 82, the input terminal 83 and the contact 92 are electrically connected. Moreover, when a print substrate is inserted from the opening 91*a*, an end of this print substrate is clamped by the pair of clamping fragments 92*a* and 92*a*, and therefore this print substrate and this contact 92 are electrically connected.

In this manner, the small-size motor according to Patent Publication 1 is made to be such that, after the connector unit is attached to an end plate of the small-size motor, by only a simple operation of inserting an end edge portion of a print substrate (for example, an FPC) into the connector unit, the print substrate can be attached to the small-size motor with certainty. Moreover, since the print substrate is removable from the connector unit, it is described that modifications to a print substrate with a different circuit specification are extremely simple, and that it is possible to increase maintainability from a user's side as a set maker.

However, compact electronic equipment for photographic use of recent years is packaged to be overcrowded with internal constituent elements. However, as shown in Patent Publication 1, there is no room to provide a small-size motor on a housing-equipped contact, and housing-equipped contacts are becoming difficult to be accepted from the side of users who are set makers. A socket contact connectable to an input terminal of a small-size motor is sought that is capable of providing a bare contact on a print substrate without holding a contact to a housing.

In particular, electronic equipment for photographic use of recent years is being developed to be more compact. Therefore, for example, small-size motors used in compact electronic equipment for photographic use have an outer diameter of the order of 8 mm. In addition, a protruding length of an input terminal is to be 1 mm or less. That is to say, a socket contact made to have a low profile (a low mounting height) connectable to an extremely small tab-shaped contact is sought.

Moreover, in order to reduce contact resistance when connecting the input terminal of the small-size motor to the socket contact, it is preferable to apply gold plating to this input terminal. However, in order to reduce the manufacturing cost of small motors, usually gold plating is not applied to input terminals. The input terminals are either metal plates that are uncoated, or at best a degree of plating by zinc plating or tin plating is applied thereto. Therefore, in order to ensure a certain contact resistance or less, a structure in which contact pressure is increased is sought for the socket contact.

Furthermore, in mounting this socket contact on a print substrate, it is preferable for the socket contact to have a structure that can be easily automatically assembled, thereby increasing productivity. The above can be said to be the objective of the present invention.

SUMMARY OF THE INVENTION

The present invention was made in view of the above-mentioned problem, the objective thereof being to provide a socket contact which elastically connects to an extremely small tabular tab-shaped contact, is mountable on a print substrate without being included in a housing, has a high contact pressure and a low profile, and is capable of being easily assembled.

The inventors of the present invention have discovered that, by creating a structure in which a bare socket contact is situated opposite to a pair of inverted arms and bellows type arms, these issues could be solved. This lead to the invention of a new socket contact such as the one hereinafter.

In a first aspect of the present invention, a socket contact that connects to a tabular tab-shaped contact and is mountable to a print substrate, the socket contact includes: a substantially rectangular tabular base portion that is disposed on the print substrate; and a contact connecting portion that is disposed in a central portion of the base portion and connects to the tab-shaped contact. The base portion includes: an opening provided in a central portion through which the tab-shaped contact passes, a pair of first lead portions extending substantially parallel to the base portion in a mutually opposing orientation in a direction toward a first pair of wings and solderable to the print substrate, and a pair of second lead portions extending substantially parallel to the base portion from one of a second pair of wings orthogonal to the first pair of wings, and solderable to the print substrate. The contact connecting portion includes: a pair of first bending fragments such that one portion of the first pair of wings of the base portion is curved and extends substantially parallel in an insertion direction of the tab-shaped contact; a pair of first inverted arms such that each one wing of the first bending fragments is curved, and the pair of first inverted arms extend in mutually approaching directions, while front end portions thereof are separated apart from each other at a prescribed distance and invert toward an interior of the contact connecting portion; a pair of second bending fragments such that another of the second pair of wings of the base portion is curved and extends substantially parallel to the insertion direction of the tab-shaped contact; and a pair of second inverted arms extending from front ends of the pair of second bending fragments to the interior of the contact connecting portion, and inverted toward the opening. A contact point is provided on the front end face of the pair of first inverted arms to be in contact with one face of the tab-shaped contact. A guiding face is provided on the pair of second inverted arms such that another face of the tab-shaped contact slides.

The socket contact according to the first aspect of the present invention connects to a tabular tab-shaped contact, and is capable of being mounted to a print substrate. In addition, the socket contact includes a substantially rectangular tabular base portion and a contact connecting portion. The base portion is provided on the print substrate. The contact connecting portion is provided in a central portion of the base portion and connects to the tab-shaped contact.

The base portion has substantially rectangular tablar shape. In this specification, the lateral sides of the base portion are referred to a first pair of wings, and the longitudinal sides of the base portion are referred to a second pair of wings.

The base portion has an opening and a pair of first and second lead portions. The opening is provided in a central portion of the base portion, and the tab-shaped contact passes therethrough. The pair of first lead portions extends in an orientation substantially parallel and mutually opposing toward the first pair of wings, and is solderable to the print substrate. The pair of second lead portions extends substantially parallel to the base portion from one of a second pair of wings orthogonal to the first pair of wings, and is solderable to the print substrate.

The contact connecting portion has a pair of first bending fragments and a pair of first inverted arms. The pair of first bending fragments is such that one portion of the first pair of wings of the base portion is curved, and extends substantially parallel in a direction of insertion of the tab-shaped contact. The pair of first inverted arms is such that one wing of these first bending fragments is curved, and the arms extend in mutually approaching directions, while the front end portions thereof are placed apart from each other at a prescribed distance and invert toward an interior of the contact connecting portion.

Moreover, the contact connecting portion has a pair of second bending fragments and a pair of second inverted arms. The pair of second bending fragments is such that another of the second pair of wings of the base portion is curved, and extends substantially parallel to an insertion direction of the tab-shaped contact. The pair of second inverted arms extends from front ends of the pair of second bending fragments to the interior of the contact connecting portion, and inverts toward the opening.

In addition, on the front end face of the pair of first inverted arms, a contact point in contact with one face of the tab-shaped contact is provided. On the pair of second inverted arms, a guiding face on which another face of the tab-shaped contact slides is provided.

Here, the tabular tab-shaped contact may be, for example, an input terminal included with a small-size motor, or may be a tab-shaped electric contact which is a male contact in which the contact portion is slender and plate-shaped, or may be a blade contact in which a cross-section having a chamfered insertion portion is rectangular and does not have springiness, or may be a male tab also called a "faston tab." The tab-shaped contact is an opposing contact connected to this socket contact such that a wire may be crimped, or may be mounted on the print substrate. The blade contact may be attached to the housing.

The socket contact connecting with the tab-shaped contact implies that the same may be connected electrically and mechanically, and that the same may be removably connected. The socket contact has at least a spring fragment, and by way of this spring fragment clamping the tab-shaped contact, electrical and mechanical connection becomes possible.

The print substrate may be a hard rigid substrate, or a soft flexible substrate, and the socket contact is installed thereon. The socket contact being installed on the print substrate includes surface mounting in which the socket contact is surface-mounted on the print substrate, and leads of the socket contact are fixed to the print substrate by reflow soldering. This Surface Mounting Technology (SMT) is suited toward automated mounting.

The flexible base plate can function as a flat flexible cable alternative to wire. This kind of flat flexible cable is called an "FPC" (Flexible Printed Circuit) or "FFC" (Flexible Flat Cable). By installing a socket contact into the flexible base plate, it is possible to achieve a so-called wire-to-wire connector and a wire-to-print substrate connector. By installing the socket contact into a rigid base plate, it is possible to achieve a print substrate-to-print substrate connector.

The socket contact according to the first aspect of the present invention does not include a housing, but is a bare socket contact formed by bending a deployed metal plate, as described below. In addition, by way of the socket contact being installed on the print substrate, this socket contact functions as a print substrate connector.

By the base portion being provided on the print substrate, this does not necessarily mean that the bottom face of the base portion abuts the surface of the print substrate. Moreover, the same does not necessarily mean that the bottom face of the base portion is soldered to the print substrate. For example, the first and second lead portions are higher than the bottom face of the base portion by a step therein, and the first and second lead portions are soldered to the print substrate. In this manner, since first and second lead portions of low heat capacity are soldered thereon, soldering strength is assured, without absorption of heat by the socket contact main body of high heat capacity.

For the opening provided in the central portion of the base portion, it is preferable to be sufficiently larger than a cross-sectional area of the tab-shaped contact. In addition, the four corners of rectangular openings may acceptably be formed in circular arcs, and a central portion of a longitudinal direction of the openings may be cut and removed. The tab-shaped contact passes therethrough. In the print substrate, an opening of a shape identical to the opening of the base portion may be provided, and the tab-shaped contact is inserted toward the contact connecting portion from the print substrate.

"Passing through" means being inserted and proceeding through. The tab-shaped contact need not be made to engage with the opening of the bottom portion, and, for example, movement of the tab-shaped contact in the width direction is restricted by the pair of second strip pieces. The opening of the bottom portion may be a so-called through hole.

"The pair of first lead portions extending substantially parallel to the base portion in a mutually opposing orientation in a direction toward a first pair of wings" may imply that the pair of first lead portions extending by a step from the bottom face of the base portion. For the pair of first lead portions extending in a mutually opposing orientation, it is preferred that the same extend symmetrically with respect to a line, and one portion of the first pair of wings of the bottom portion extends in a mutually opposing orientation. Most of the first pair of wings of the base portion is curved as the pair of first bending fragments, described below.

"The pair of second lead portions extending substantially parallel to the base portion from one of a second pair of wings orthogonal to the first pair of wings" may imply that the pair of first lead portions extending with a step from the bottom face of the base portion. For the pair of second lead portions, it is preferable for both end portions of one of the second pair of wings to extend partially, and in the central portion of one of the second pair of wings, the fourth bending fragment described below to be curved.

It is preferred that the the pair of first lead portions and the pair of second lead portions be separated sufficiently, and by placing the pair of first lead portions extending in mutually opposing directions and the pair of second lead portions extending in one direction so as to extend on three sides of the base portion, thereby stabilizing the stance of the socket contact.

For the pair of first bending fragments, a portion of the first pair of wings may be curved, and extend substantially parallel to a direction of insertion of the tab-shaped contact. It is preferable for the pair of first bending fragments to extend up to a height equal to a wide pair of third bending fragments described later, and thus this socket contact can be low profile.

For the pair of first inverted arms, one wing of the first pair of bending fragments may be curved and extend in mutually approaching directions. In addition, the front end portions of the pair of first inverted arms together may be separated at a prescribed distance, and the front end portions of the pair of first inverted arms invert toward the interior of the contact connecting portion.

The front end portions of the pair of first inverted arms together may be separated at a prescribed distance, so as to be in contact with one face of the tab-shaped contact, and the front end portions of the pair of first inverted arms may together be separated at a prescribed distance, so that a pair of second strip pieces described later may be placed. In addition, the front end portions of the pair of first inverted arms together extend toward a guiding face in which another face of the tab-shaped contact slides.

For the pair of second bending fragments, another of the second pair of wings of the base portion may be curved, and extends substantially parallel to a direction of insertion of the tab-shaped contact. For the pair of second inverted arms may extend from a front end of the pair of second bending fragments to an interior of the contact connecting portion, and furthermore, may be inverted toward an opening provided on the base portion. The front end faces of the pair of second inverted arms is preferably not to reach a bottom face of the base portion.

In addition, on the front end faces of the pair of first inverted arms, contact points in contact with one face of the tab-shaped contact are provided. These contact points, on an expansion sheet prior to bending processing, may be hemispherical protrusions pre-formed on a front end face of the pair of first inverted arms, and may be circular arc faces pre-formed on a front end face of a pair of the first inverted arms.

Moreover, on the pair of second inverted arms, a guiding face is provided on which another face of the tab-shaped contact slides. Here, the pair of second inverted arms are multiply bent, and by shortening a distance from a fixed end to a working end on which a load acts, and when an external force operates (that is to say, when a tab-shaped contact is inserted), deformations can be disregarded because the pair of second inverted arms functions as a rigid body.

In the socket contact according to the first aspect of the present invention, a pair of first inverted arms and a pair of second inverted arms are placed to be separated opposite each other at a prescribed distance. It can also be said that the contact point and the guiding face are arranged opposite each other at a distance less than or equal to a board thickness of the tab-shaped contact. When the tab-shaped contact is inserted from the opening of the base portion, while another face of the tab-shaped contact slides along the guiding face, the pair of first inverted arms is moved to the outer side. That is to say, the pair of first inverted arms is elastically deformed, and can be bent. In addition, as a reaction to being elastically deformed, the contact point can provide a prescribed contact pressure on the tab-shaped contact.

The socket contact according to the first aspect of the present invention does not include a housing, and by being formed as a bare socket contact by multiply bending an expanded metallic sheet, may be mounted on a print substrate, achieving a low-profile structure having high contact pressure, which is connectable to an extremely small tab-shaped contact.

In a second aspect of the present invention, a socket contact that connects to a tabular tab-shaped contact, having a plurality of through holes, and being mountable on a print substrate, the socket contact includes: substantially rectangular tabular base portion that is disposed on the print substrate; and a contact connecting portion that is disposed in a central portion of the base portion, connecting to the tab-shaped contact. The base portion includes: an opening provided in a central portion through which the tab-shaped contact passes; a pair of first pins in which parts of a first pair of wings extend substantially parallel to each other on an opposite side of the base portion and are inserted into the through holes; and a pair of second pins in which parts of one of a second pair of wings substantially orthogonal to the first pair of wings, extend substantially parallel to each other on an opposite side of the base portion and are inserted into the through holes. The contact connecting portion includes: a pair of first bending fragments such that one portion of the first pair of wings of the base portion is curved and extends substantially parallel in an insertion direction of the tab-shaped contact; a pair of first inverted arms such that each one wing of the first bending fragments is curved, and the air of first inverted arms extend in mutually approaching directions, while front end portions thereof are separated apart from each other at a prescribed distance and invert toward an interior of the contact connecting portion; a pair of second bending fragments such that another of the second pair of wings of the base portion is curved and extends substantially parallel to the insertion direction of the tab-shaped contact; and a pair of second inverted arms extending from front ends of the pair of second bending fragments to the interior of the contact connecting portion, and inverts toward the opening. A contact point is provided on a front end face of the pair of first inverted arms to be in contact with one face of the tab-shaped contact; and a guiding face is provided on the pair of second inverted arms such that another face of the tab-shaped contact slides thereon.

The socket contact according to the second aspect of the present invention connects to a tabular tab-shaped contact, and is capable of being mounted to a print substrate having a plurality of through holes. In addition, the socket contact includes a substantially rectangular tabular base portion and a contact connecting portion. The base portion is provided on the print substrate. The contact connecting portion is provided in a central portion of the base portion, and connects to the tab-shaped contact.

The base portion has an opening and pair of first pins. The opening is provided in a central portion of the base portion, and the tab-shaped contact passes therethrough. In a pair of first pins, parts of the first pair of wings of the base portion extend substantially parallel to each other on an opposite side of the base portion and are inserted into the through holes of the print substrate.

Moreover, the base portion has a pair of second pins. In a pair of second pins, part of one of a second pair of wings substantially orthogonal to the first pair of wings of the base portion extends substantially parallel to on an opposite side of the base portion, and is inserted into the through holes.

The contact connecting portion has a pair of first bending fragments and a pair of first inverted arms. The pair of first bending fragments is such that one portion of the first pair of wings of the base portion is curved, and extends substantially parallel in a direction of insertion of the tab-shaped contact. The pair of first inverted arms is such that one wing of this pair of first bending fragments is curved, and extends in mutually approaching directions, while the front end portions thereof are placed apart from each other at a prescribed distance and invert toward an interior of the contact connecting portion.

Moreover, the contact connecting portion has a pair of second bending fragments and a pair of second inverted arms. The pair of second bending fragments is such that another of the second pair of wings of the base portion is curved, and extends substantially parallel to a direction of insertion of the tab-shaped contact. The pair of second inverted arms extends from front ends of the pair of second bending fragments to the interior of the contact connecting portion, and inverts toward the opening.

In addition, on the front end face of the pair of first inverted arms, a contact point in contact with one face of the tab-shaped contact is provided. On the pair of second inverted arms, a guiding face is provided on which another face of the tab-shaped contact slides.

Here, although the print substrate having the plurality of through holes may preferably use a rigid plate, a flexible plate is not excluded. "The socket contact to be mounted in the print substrate having the plurality of through holes" includes through hole mounting in which the pins are passed through the through holes, and the pins are soldered from the face opposite to mounting; and a non-soldered connection in which the pins are processed by press-fit termination, and this press fit termination is pressed into the through holes. Using an automatic mounting apparatus, it is possible to automate through hole mounting or a non-soldered connection.

The pair of first pins and the pair of second pins are preferably sufficiently separated, and the pair of first pins and the pair of second pins are preferably placed so as to extend on three sides of the base portion, thereby stabilizing the stance of the socket contact.

The socket contact according to the second aspect of the present invention does not include a housing, and by being formed as a bare socket contact by multiply bending an expanded metallic sheet, the same may be mounted on a print substrate, achieving a low-profile structure having high contact pressure, connectable to an extremely small tab-shaped contact. In particular, it is preferable that the same be used in a rigid substrate.

According to a third aspect of the present invention, the pair of first inverted arms has a central portion that is open so that one wing of the first pair of bending fragments is easily curved.

The socket contact according to the third aspect of the present invention is such that it is preferable for a pair of bending fragments in an expansion sheet to be bent at a right angle at a pair of dies, and by opening a central portion of a pair of first inverted arms along a longitudinal direction, it is possible to curve thereof without twisting one wing of the pair of bending fragments of narrow width.

In a fourth aspect of the present invention, the socket contact may include a pair of first strip pieces in which both wings of the pair of second bending fragments are curved and face opposite each other; and a pair of third bending fragments that are wide in width in which the first strip pieces are curved and face toward the base portion, in which an exterior face of the pair of third bending fragments forms a flat surface capable of vacuum adhesion.

The socket contact according to the fourth aspect of the present invention includes a pair of first strip pieces and a wide pair of third bending fragments. The pair of first strip pieces is such that both wings (sides) of the pair of second bending fragments are curved and face opposite each other. The pair of third bending fragments is such that the pair of first strip pieces is curved and face toward the base portion. In addition, the pair of third bending fragments is such that an exterior face of this pair of third bending fragments forms a flat surface capable of vacuum adhesion.

For an automatic mounting apparatus that conveys goods from one site to another site, there is a method of gripping goods with a chuck-hand, and a method of vacuum suction of the goods with a suction hand. Such minute goods as socket contacts have almost no portion to be held, and therefore a vacuum-suction method is suited, but a flat surface to vacuum-suction to is required. Therefore, the socket contact according to the fourth aspect of the present invention forms a vacuum-adsorbent flat face on an external face of a pair of third bending fragments, creating a preferred structure for an automatic mounting apparatus.

In a fifth aspect of the present invention, the socket contact may include a pair of second strip pieces in which both wings of the pair of second inverted arms are curved and face opposite each other, in which the pair of second inverted arms restricts lateral movement of the tab-shaped contact.

A pair of second strip pieces may be separated at a prescribed distance, and is separated at a distance marginally broader than a width of the tab-shaped contact. In a case in which the tab-shaped contact is correctly inserted into the opening, the pair of second strip pieces can be passed through by the tab-shaped contact. In a case in which the tab-shaped contact is irregularly inserted into the opening, blocked by the pair of second strip pieces, the tab-shaped contact does not pass through easily. In this manner, by the pair of second strip pieces composing a protective barrier, it is possible to protect a tab-shaped contact from irregular insertion.

Moreover, for the pair of second strip pieces, a front end portion of a pair of first inverted arms may be placed in an interior, and thus preventing unnecessary spreading of the front end portions of the pair of first inverted arms together in opposing directions.

In a sixth aspect of the present invention, the socket contact may include a fourth bending fragment such that a central portion at another of the second pair of wings of the base portion is curved and extends substantially parallel in the insertion direction of the tab-shaped contact; and a third inverted arm extending from a front end of the fourth bending fragment to the interior of the contact connecting portion and inverting toward the opening; in which the third inverted arm is placed between the pair of first inverted arms and restricts receding movement of the pair of first inverted arms when the tab-shaped contact is inserted.

The socket connector according to the sixth aspect of the present invention includes a fourth bending fragment and a third inverted arm. The fourth bending fragment is such that a central portion of another of the second wings of the base portion is curved, and extends substantially parallel in a direction of insertion of the tab-shaped contact. The third inverted arm extends from a front end of the fourth bending fragment to an interior of the contact connecting portion, and is inverted toward the opening. In addition, the third inverted arm is placed between the pair of first inverted arms, and when the tab-shaped contact is inserted, restricts receding movement of the pair of first inverted arms.

Since in the socket contact according to the sixth aspect, the third inverted arm restricts excess movement of the pair of first inverted arms, it is possible to prevent elastic deformation exceeding the limit of elasticity of the pair of first inverted arms.

In a seventh aspect of the present invention, the socket contact may include a fourth inverted arm such that another of the second pair of wings of the base portion is curved and inverts toward an interior of the contact connecting portion, and faces the third inverted arm; in which a front end portion of the fourth inverted arm locks into a hole provided on the tab-shaped contact, and prevents dropping of the tab-shaped contact.

The socket contact according to the seventh aspect of the present invention is such that, by a protrusion locking onto a hole provided on the tab-shaped contact, it is possible to verify an insertion position of the tab-shaped contact. Moreover, there is also the effect that the tab-shaped contact is not easily removed from the socket contact.

According to an eighth aspect of the present invention, the socket contact may be formed by bending an expanded metallic sheet.

The socket contact according to the eighth aspect of the present invention can be made into a catenulate contact in which the expanded metallic sheet is connected in a catenulate (chained) manner by a contact carrier.

In a ninth aspect of the present invention, a carrier tape may provide a series of concave portions housing the socket contact.

For example, the carrier tape is composed of transparent strip-shaped plastic, and a plurality of concave portions housing socket contacts are formed. The concave portions are formed into a shape matching a contour of the socket contact, and the stances of the housed socket contacts are stabilized. When transporting the carrier tape, the carrier tape is wound into a roll shape, and the concave portions are sealed with cover tape. When removing the socket contact, the carrier tape is flattened, and the cover tape is peeled off. By using this kind of carrier tape, removal of a socket contact by way of an automatic mounting apparatus (vacuum-suction method) becomes simple.

In a tenth aspect of the present invention, a flexible substrate may include the socket contact.

In an eleventh aspect of the present invention, a rigid substrate may include the socket contact.

In a twelfth aspect of the present invention, an electronic device may include the socket contact.

In a thirteenth aspect of the present invention, an electronic device may include the flexible substrate according to the tenth aspect.

In a fourteenth aspect of the present invention, an electronic device may include the rigid substrate according to the eleventh aspect.

The socket contact according to the present invention does not include a housing, and by being formed as a bare socket contact by multiply bending an expanded metallic sheet, the socket contact may be mounted on a print substrate, achieving a low-profile structure having high contact pressure, connectable to an extremely small tab-shaped contact.

Moreover, the socket contact according to the present invention forms a vacuum-suction flat face on an external face of a pair of third bending fragments, creating a preferred structure for an automatic mounting apparatus.

BRIEF DESCRIPTION OF THE DRAWINGS

FIG. 17 is a figure showing a socket contact after being formed by bending according to the embodiment, in which

DETAILED DESCRIPTION OF THE INVENTION

Hereinafter, a preferred embodiment of the present invention is explained.

Figure 1:
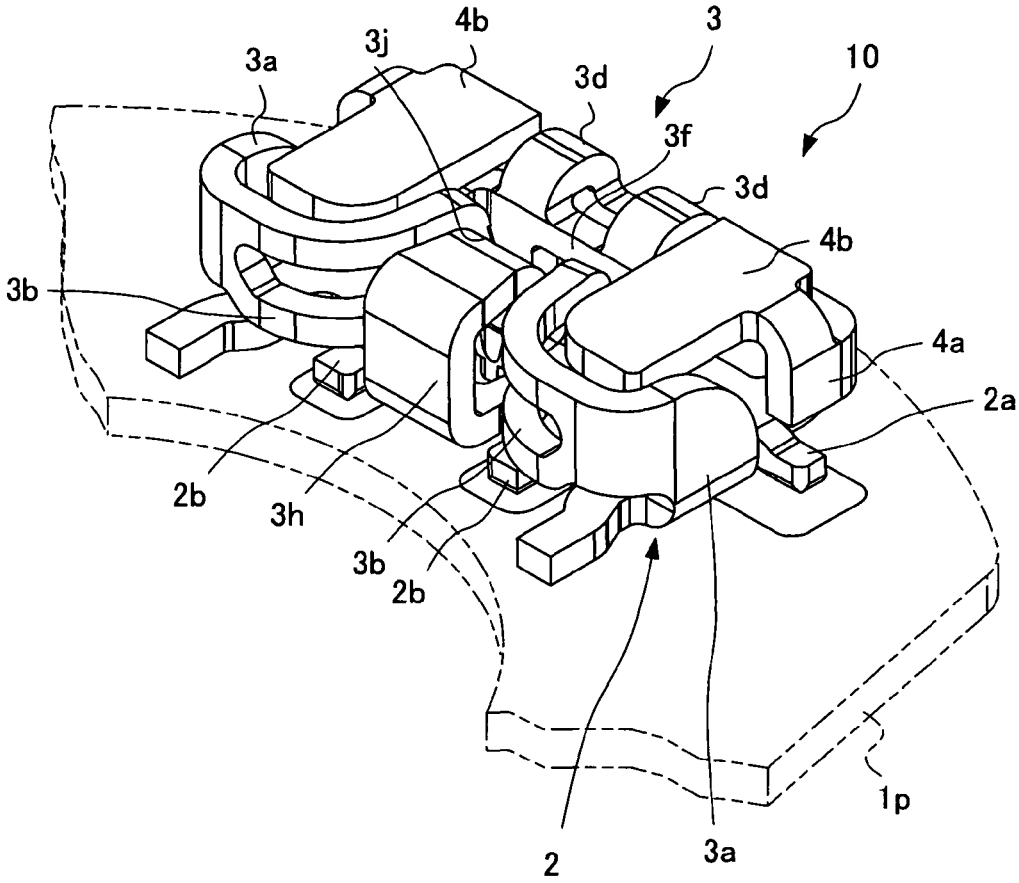
FIG. 1 is an external perspective view showing an embodiment of a socket contact according to the present invention.
Figure 2:
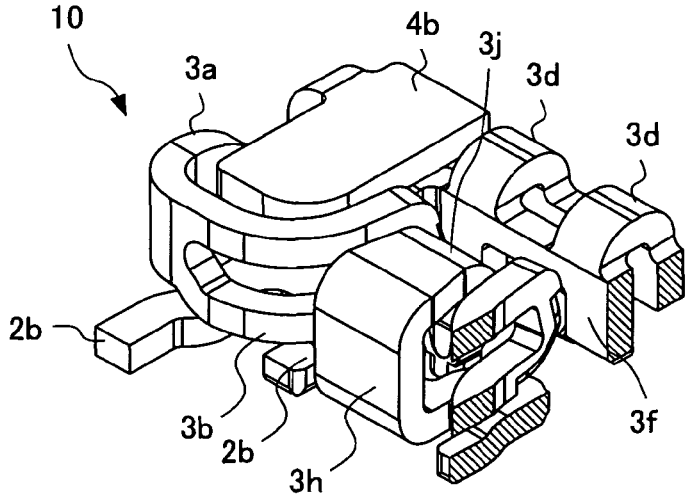
FIG. 2 is an external perspective view showing a socket contact according to the embodiment, and shows the main parts in a vertical section.
Figure 3:
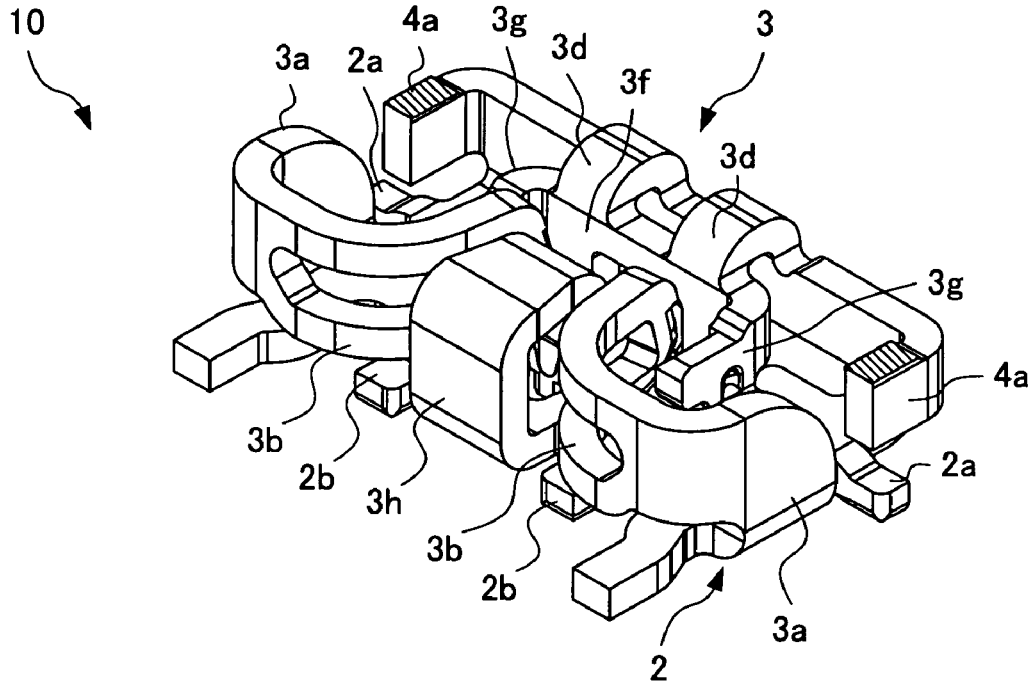
FIG. 3 is an external perspective view showing a socket contact according to the embodiment, and shows the main parts in a horizontal section.
Figure 4:
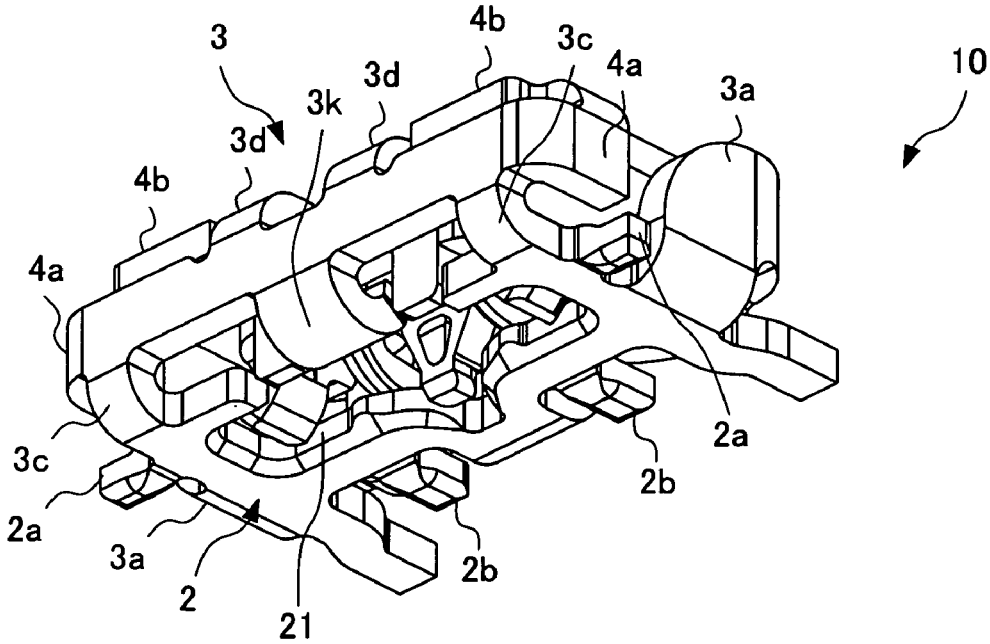
FIG. 4 is an external perspective view showing a socket contact according to the embodiment, and shows the socket contact as seen from a lower face.

FIG. 1 is an external perspective view showing one embodiment of a socket contact according to the present invention. FIG. 2 is an external perspective view showing a socket contact according to the embodiment, and shows the main parts in a vertical section. FIG. 3 is an external perspective view showing a socket contact according to the embodiment, and shows the main parts in a horizontal section. FIG. 4 is an external perspective view showing a socket contact according to the embodiment, and shows the socket contact as seen from a lower face.

Figure 5:
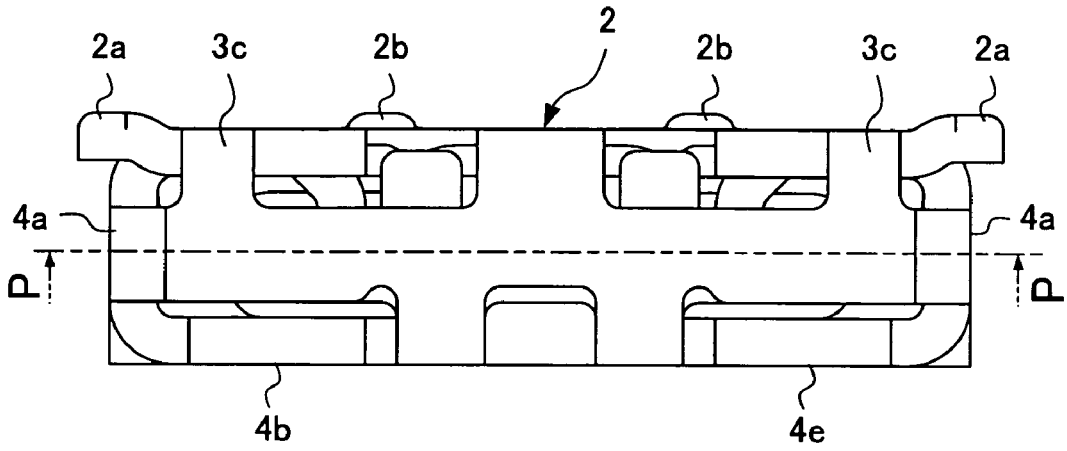
FIG. 5 is a rear view showing a socket contact according to the embodiment.
Figure 6:
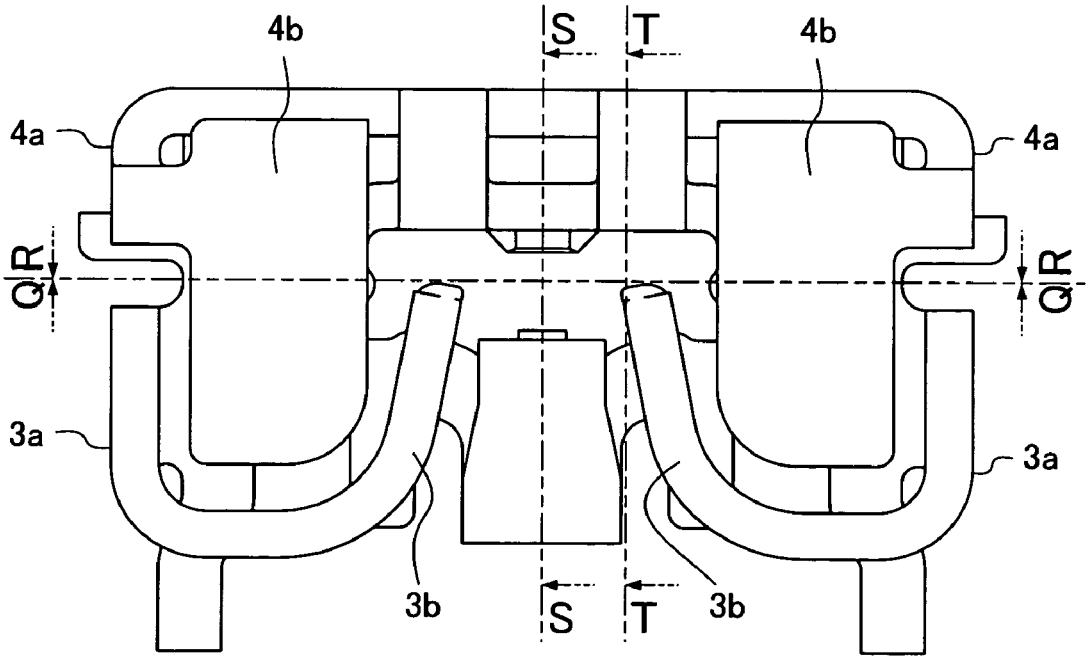
FIG. 6 is a planar view showing a socket contact according to the embodiment.
Figure 7:
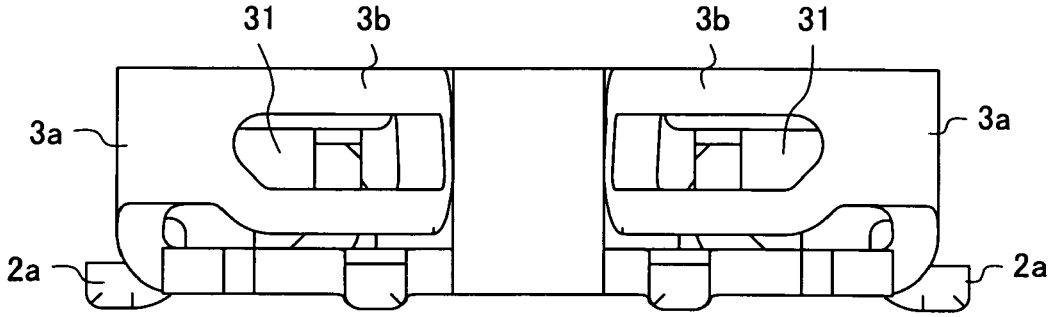
FIG. 7 is a front view showing a socket contact according to the embodiment.
Figure 8:
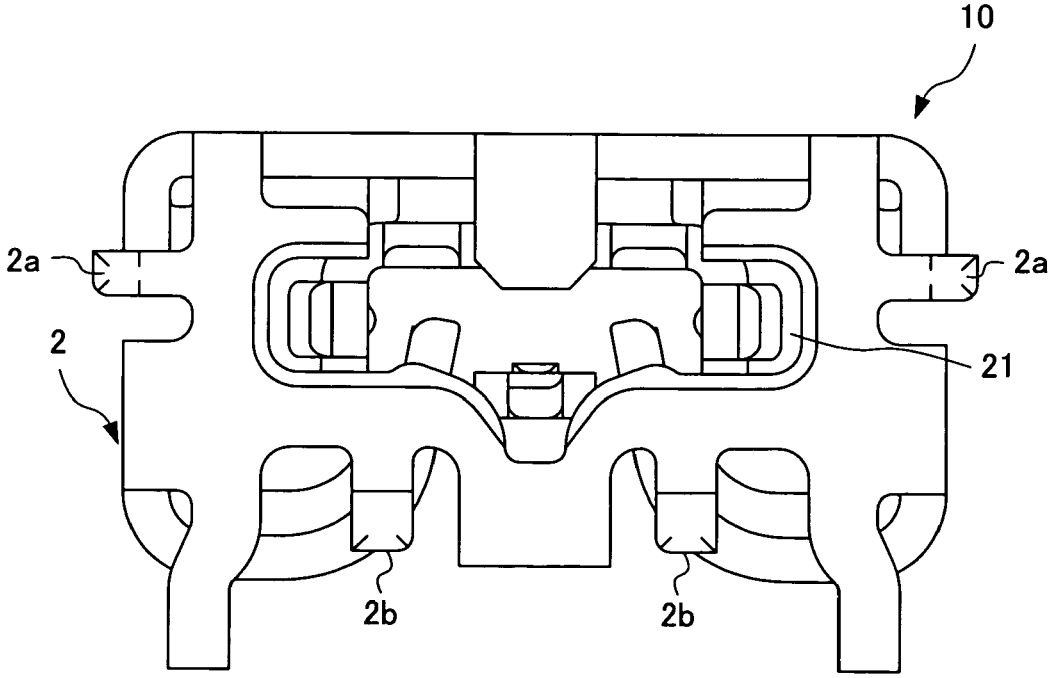
FIG. 8 is a bottom view showing a socket contact according to the embodiment.
Figure 9:
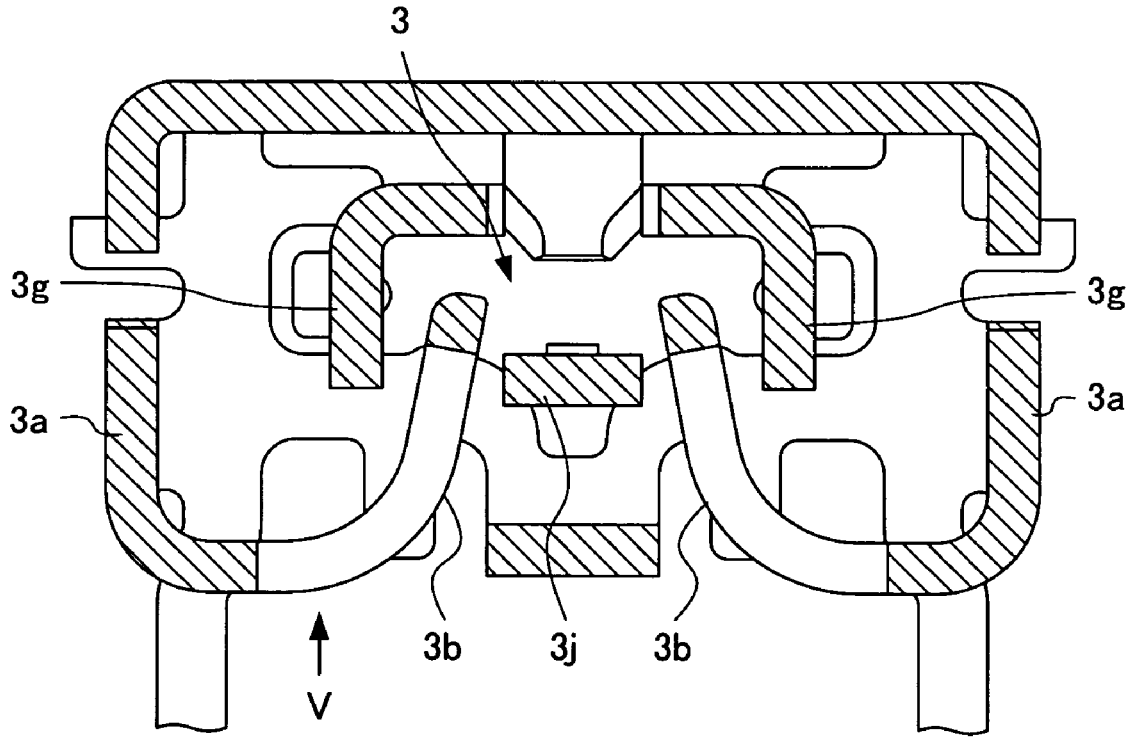
FIG. 9 is a horizontal cross-sectional view showing a socket contact according to the embodiment, and is a cross-sectional view of FIG. 5 as seen along the P-P line.

FIG. 5 is a rear view showing a socket contact according to the embodiment. FIG. 6 is a planar view showing a socket contact according to the embodiment. FIG. 7 is a front view showing a socket contact according to the embodiment. FIG. 8 is a bottom view showing a socket contact according to the embodiment. FIG. 9 is a horizontal cross-sectional view showing a socket contact according to the embodiment, and is a cross-sectional view of FIG. 5 as seen along the P-P line.

Figure 10:
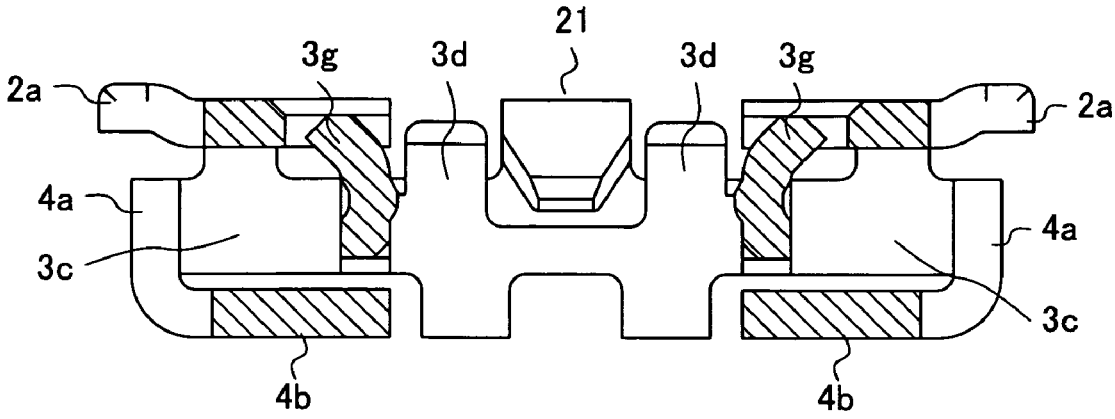
FIG. 10 is a vertical cross-sectional view showing a socket contact according to the embodiment, and is a cross-sectional view of FIG. 6 as seen along the Q-Q line.
Figure 11:
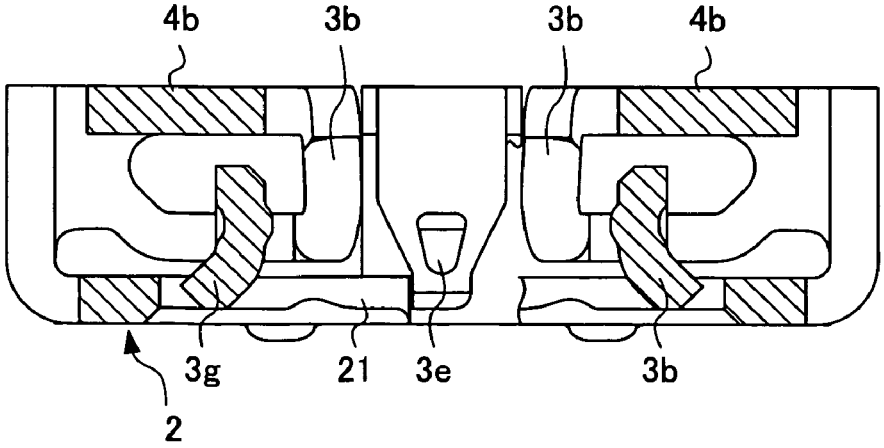
FIG. 11 is a vertical cross-sectional view showing a socket contact according to the embodiment, and is a cross-sectional view of FIG. 6 as seen along the R-R line.
Figure 12:
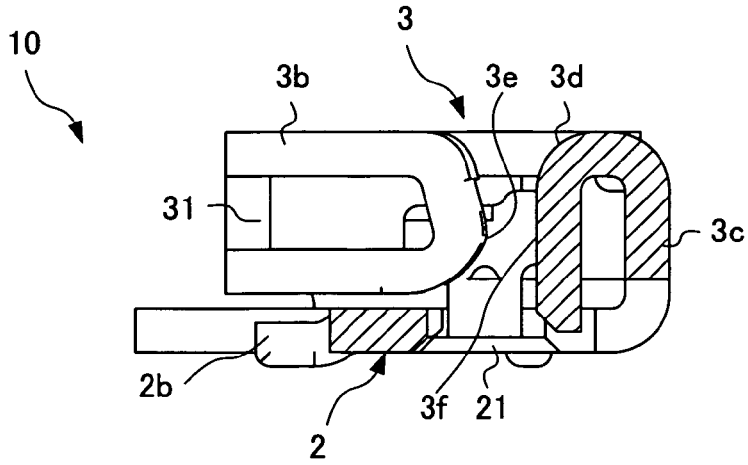
FIG. 12 is a vertical cross-sectional view showing a socket contact according to the embodiment, and is a cross-sectional view of FIG. 6 as seen along the T-T line.
Figure 13:
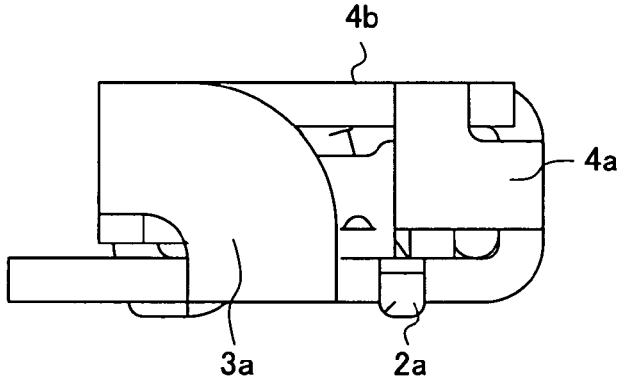
FIG. 13 is a right side view showing a socket contact according to the embodiment.
Figure 14:
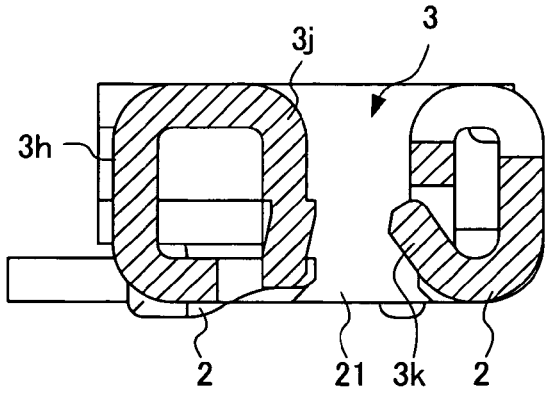
FIG. 14 is a vertical cross-sectional view showing a socket contact according to the embodiment, and is a cross-sectional view of FIG. 9 as seen along the S-S line.
Figure 15:
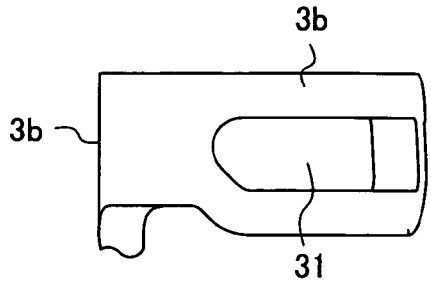
FIG. 15 is a partial diagrammatic view showing a socket contact according to the embodiment, and is a view of FIG. 9 as seen from the V arrow.

FIG. 10 is a vertical cross-sectional view showing a socket contact according to the embodiment, and is a cross-sectional view of FIG. 6 as seen along the Q-Q line. FIG. 11 is a vertical cross-sectional view showing a socket contact according to the embodiment, and is a cross-sectional view of FIG. 6 as seen along the R-R line. FIG. 12 is a vertical cross-sectional view showing a socket contact according to the embodiment, and is a cross-sectional view of FIG. 6 as seen along the T-T line. FIG. 13 is a right side view showing a socket contact according to the embodiment. FIG. 14 is a vertical cross-sectional view showing a socket contact according to the embodiment, and is a cross-sectional view of FIG. 9 as seen along the S-S line. FIG. 15 is a partial diagrammatic view showing a socket contact according to the embodiment, and is a view of FIG. 9 as seen from the V arrow.

Figure 16:
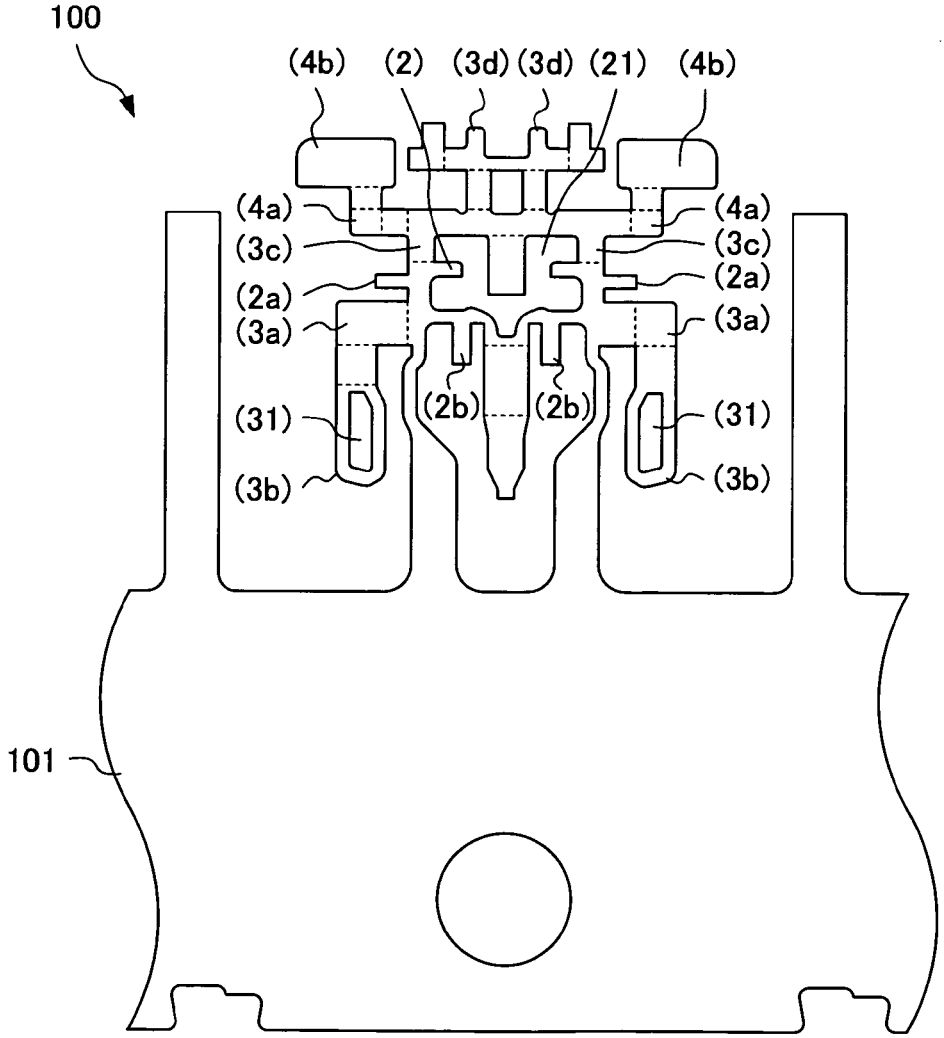
FIG. 16 is a breakdown view showing a socket contact before being formed by bending according to the embodiment.
Figure 17A:
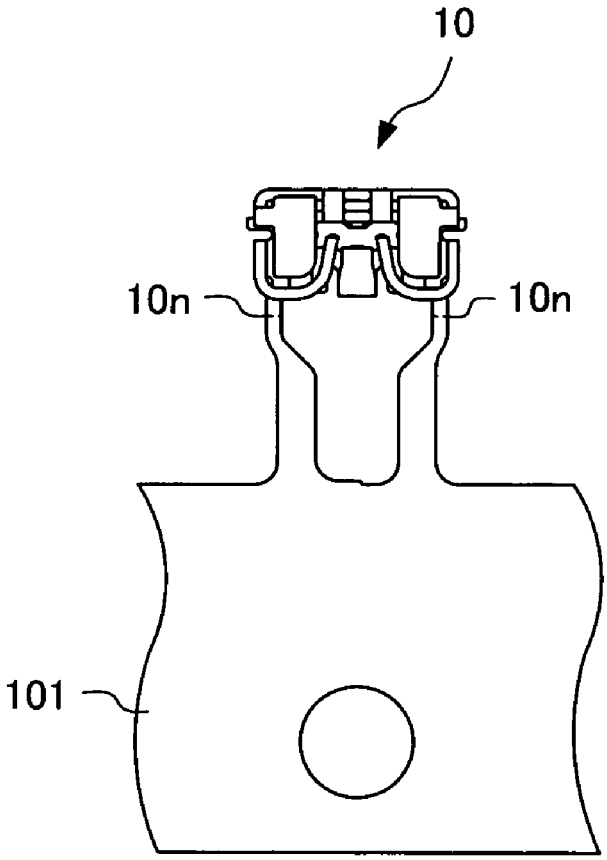
FIG. 17(A) is a planar view.
Figure 17B:
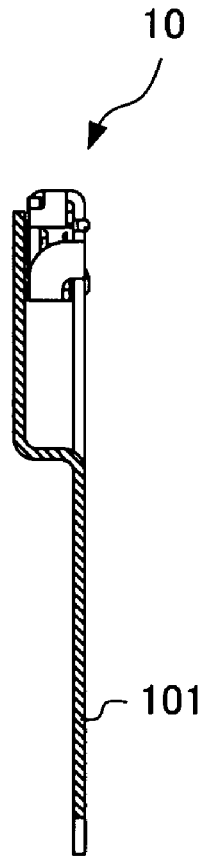
FIG. 17(B) is a right side view.
Figure 18:
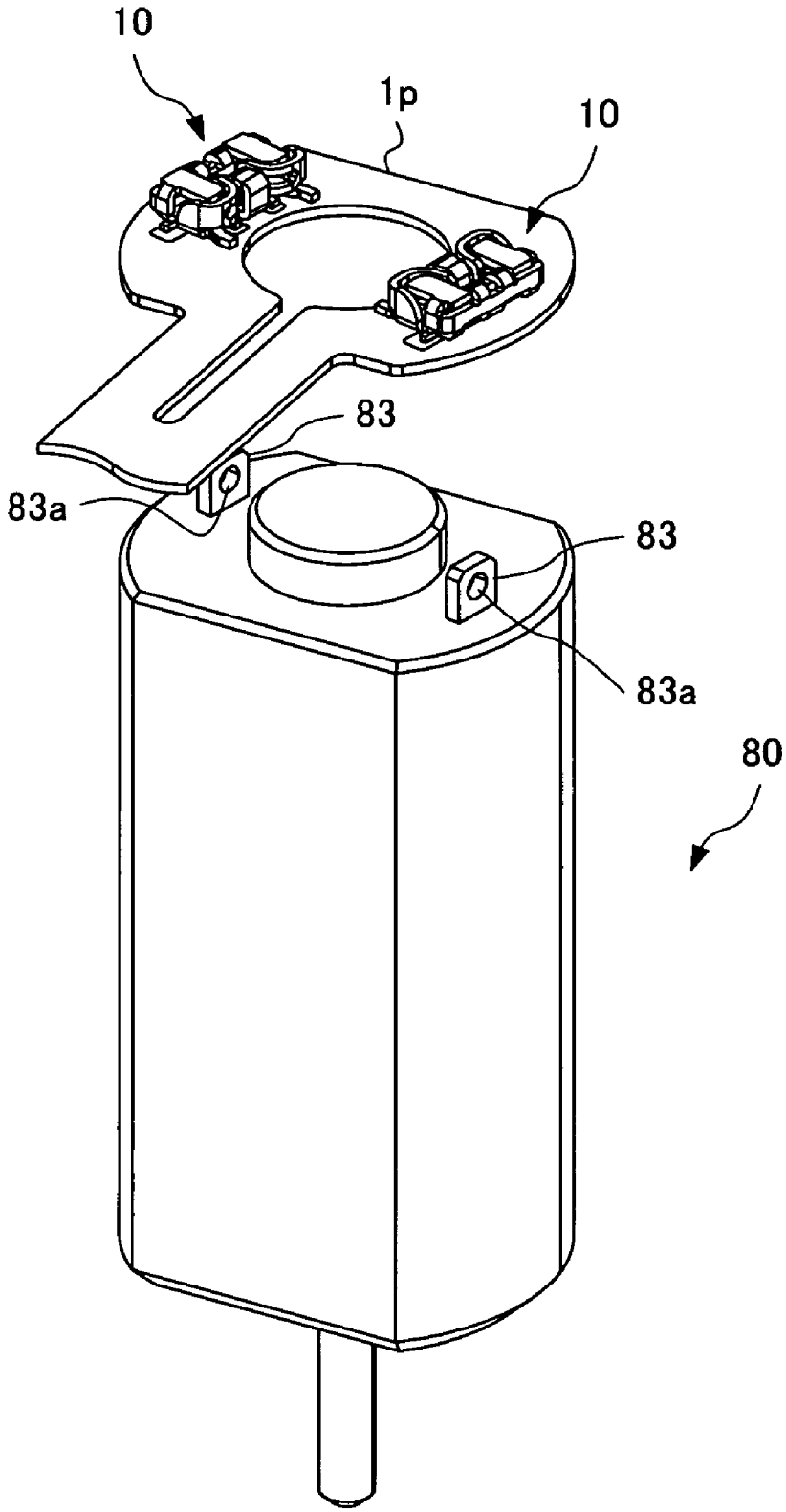
FIG. 18 is an external perspective view showing a used state of a socket contact according to the embodiment, in which a print substrate to which a socket contact is attached, and a small-size motor including a tab-shaped contact, are placed.

FIG. 16 is a breakdown view showing a socket contact before being formed by bending according to the embodiment. FIG. 17 is a figure showing a socket contact after being formed by bending according to the embodiment, in which FIG. 17(A) is a planar view, and FIG. 17(B) is a right side view. FIG. 18 is an external perspective view showing a used state of a socket contact according to the embodiment, in which a print substrate to which a socket contact is attached, and a small-size motor including a tab-shaped contact, is placed.

Figure 19:
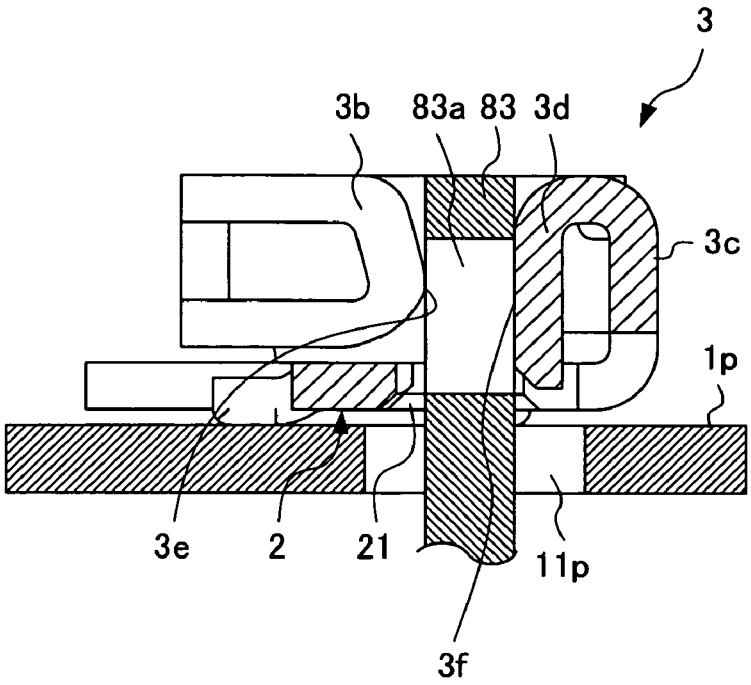
FIG. 19 is a state diagram in which a tab-shaped contact has been inserted in a vertical cross-sectional view showing the socket contact according to FIG. 12.
Figure 20:
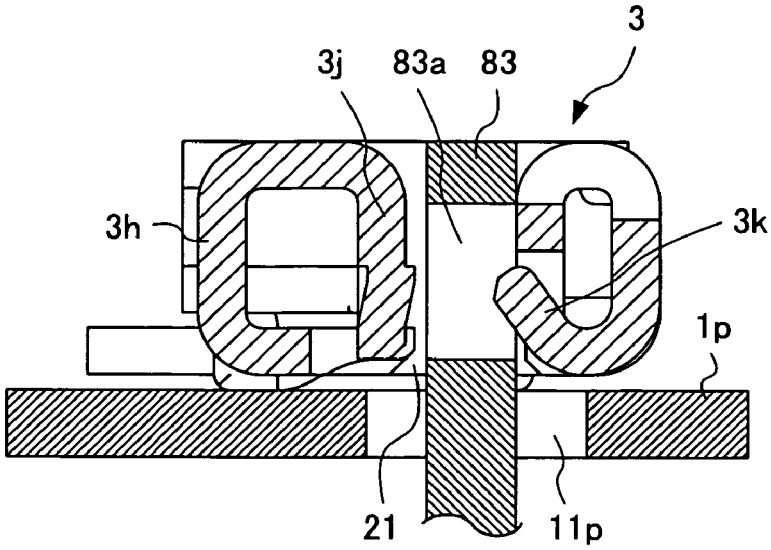
FIG. 20 is a state diagram in which a tab-shaped contact has been inserted in a vertical cross-sectional view showing the socket contact according to FIG. 14.
Figure 21:
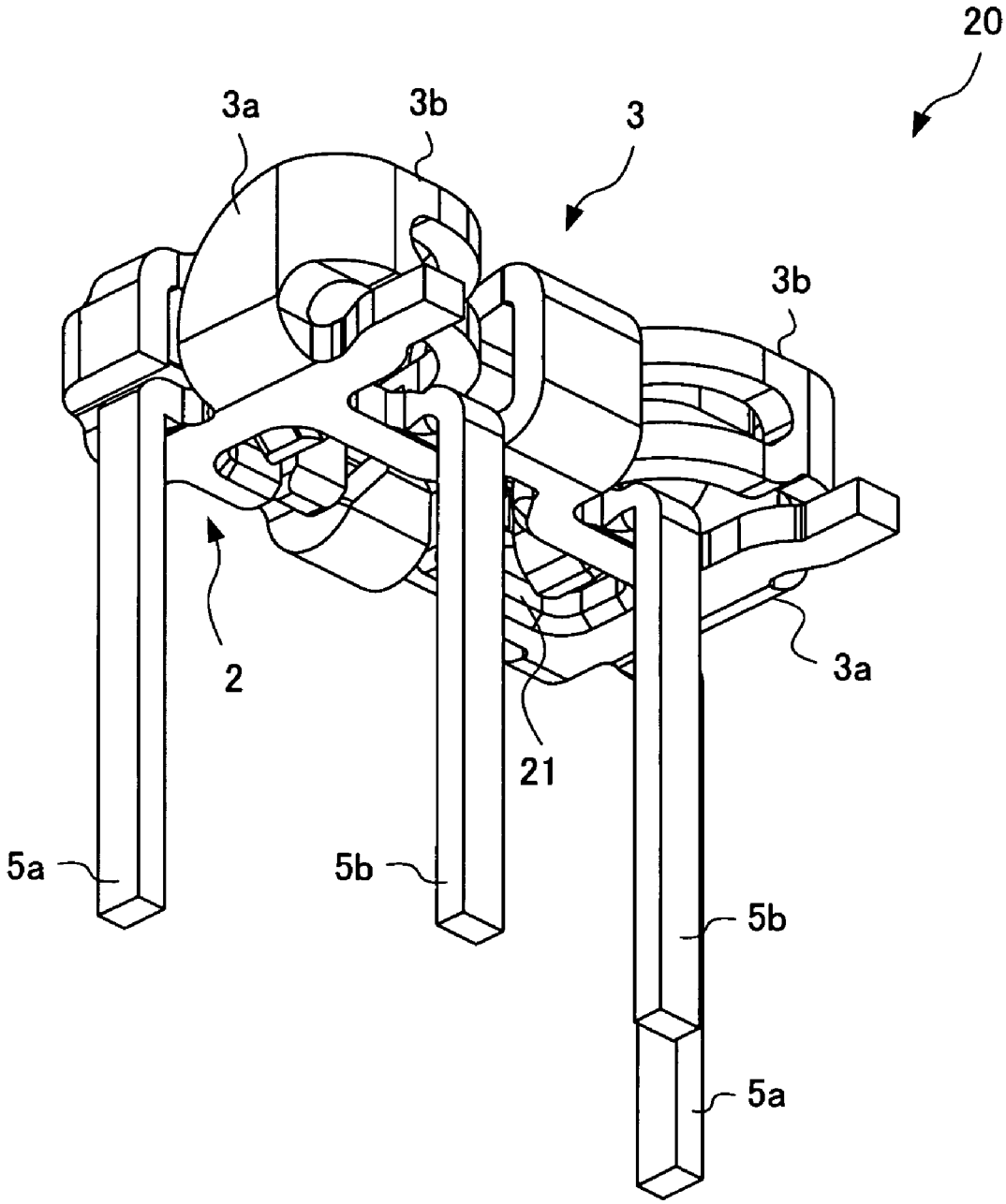
FIG. 21 is an external perspective view showing a socket contact according to another embodiment, in which this socket contact has pins to be inserted into through holes.
Figure 22:
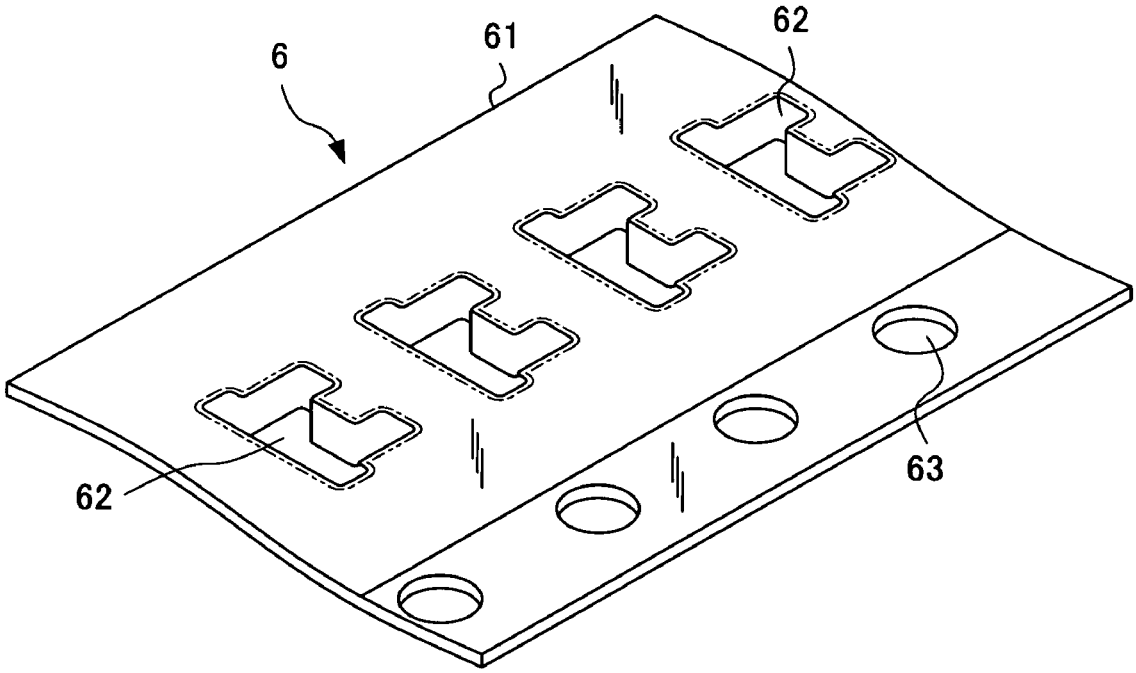
FIG. 22 is an external perspective view showing a carrier tape providing a series of concave portions housing the socket contact according to the embodiment.

FIG. 19 is a state diagram in which a tab-shaped contact has been inserted in a vertical cross-sectional view showing the socket contact according to FIG. 12. FIG. 20 is a state diagram in which a tab-shaped contact has been inserted in a vertical cross-sectional view showing the socket contact according to FIG. 14. FIG. 21 is an external perspective view showing a socket contact according to another embodiment, in which this socket contact has pins to be inserted into through holes. FIG. 22 is an external perspective view showing a carrier tape providing a series of concave portions housing the socket contact according to the embodiment.

First, a configuration of the socket contact (hereinafter called the "connector") according to the present invention is explained. In FIGS. 1 to 3, a contact 10 is connected to a tabular tab-shaped contact, and is mountable in a print substrate 1*p*. The connector 10 includes a substantially rectangular tabular base portion 2 and a contact connecting portion 3 (see FIG. 4 or 8). The base portion 2 is provided on the print substrate 1*p*. The contact connecting portion 3 is provided on a central portion of the base portion 2, and can be connected to the tab-shaped contact.

In FIGS. 1 to 3, the base portion 2 has an opening 21 and a pair of first lead portions 2*a* and 2*a*. The opening 21 is provided on the central portion of the base portion 2, and the tab-shaped contact is passed through (see FIG. 4 or FIG. 8). The pair of first lead portions 2*a* and 2*a* extends substantially parallel to the base portion 2 in a mutually opposing orientation in a direction toward a first pair of wings of the base portion 2, and is solderable to the print substrate 1*p*.

Moreover, in FIGS. 1 to 3, the base portion 2 has a pair of second lead portions 2*b* and 2*b*. The pair of second lead portions 2*b* and 2*b* extends substantially parallel to the base portion 2 from one of the second pair of wings substantially orthogonal to the first pair of wings, and is solderable to the print substrate 1*p*.

In FIGS. 1 to 3, the contact connecting portion 3 has a pair of first bending fragments 3*a* and 3*a* and a pair of first inverted arms 3*b* and 3*b*. The pair of first bending fragments 3*a* and 3*a* is such that one portion of the first pair of wings of the base portion 2 is curved, and extends substantially parallel in a direction of insertion of the tab-shaped contact (refer to FIG. 13). The pair of first inverted arms 3*b* and 3*b* is such that one wing of this pair of first bending fragments 3*a* and 3*a* is curved, and the arms extend in mutually approaching directions, while the front end portions thereof are placed apart from each other at a prescribed distance and invert toward an interior of the contact connecting portion 3.

Moreover, in FIGS. 1 to 4, the contact connecting portion 3 has a pair of second bending fragments 3*c* and 3*c* and a pair of second inverted arms 3*d* and 3*d*. The pair of second bending fragments 3*c* and 3*c* is such that another of the second pair of wings of the base portion 2 is curved, and extends substantially parallel in a direction of insertion of the tab-shaped contact (see FIG. 12). The pair of second inverted arms 3*d* and 3*d* extends from front ends of the pair of second bending fragments 3*c* and 3*c* to the interior of the contact connecting portion 3, and inverts toward an interior of the opening 21 (see FIG. 12). The pair of second inverted arms 3*d* and 3*d* is such that end portions thereof are mutually coupled (see FIG. 10).

Moreover, in FIGS. 1 to 3, on a front end face of a pair of first inverted arms 3*b* and 3*b*, a contact point 3*e* in contact with one face of the tab-shaped contact is provided (see FIG. 12). On the pair of second inverted arms 3*d* and 3*d*, a guiding face 3*f* such that another face of the tab-shaped contact slides is provided (see FIG. 12).

Figure 23:
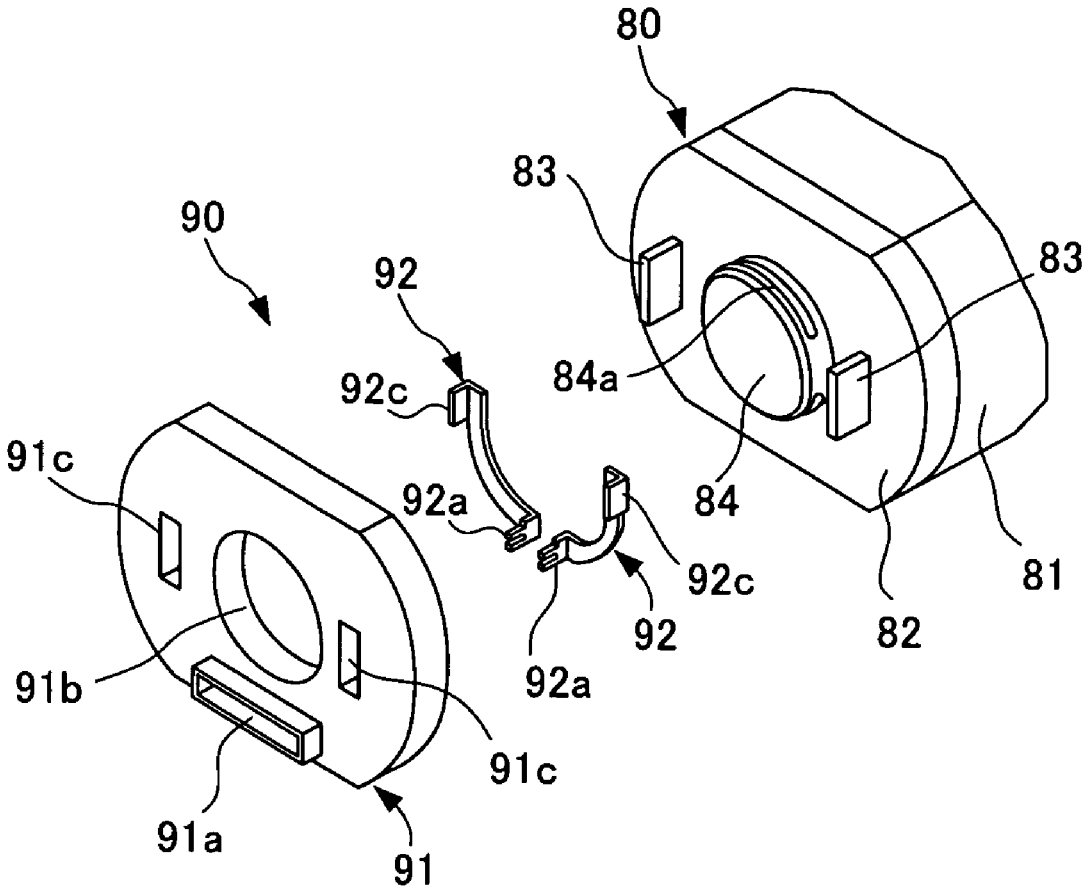
FIG. 23 is an external perspective exploded view of main portions showing an embodiment of a small-size motor according to the prior art, in which the small-size motor includes a connector unit connecting input terminals to a print substrate.

As shown in FIG. 18, the tabular tab-shaped contact may be an input terminal 83 included with the small-size motor 80. Hereinafter, the tabular tab-shaped contact is explained as being the input terminal 83, but the tabular tab-shaped contact is not limited to the input terminal 83. Moreover, in FIG. 18, components of symbols identical to FIG. 23, which is an illustration of prior art, are identical objects, and thus explanations thereof have been omitted.

In FIGS. 1 to 4, the connector 10 does not include a housing, but is a bare socket contact formed by bending an expansion sheet 100 which is an expanded metallic sheet, as shown in FIG. 16. In addition, by the connector 10 being mounted in the print substrate 1*p*, it is possible for this connector 10 to function as a print substrate connector.

In FIGS. 1 to 4, for the base portion 2 to be provided on the print substrate 1*p* does not necessarily mean that the bottom of the base portion 2 abuts the surface of the print substrate 1*p*. Moreover, the same does not necessarily mean that the bottom of the base portion 2 is soldered to the print substrate 1*p*. As shown in FIG. 5, the pair of first lead portions 2*a* and 2*a* are higher than the bottom face of the base portion 2 by a step, and the pair of first lead portions 2*a* and 2*a* are soldered to the print substrate 1*p*.

Moreover, as shown in FIG. 12, the pair of second lead portions 2*b* and 2*b* is higher than the bottom face of the base portion 2 by a step, and the pair of second lead portions 2*b* and 2*b* are soldered to the print substrate 1*p* (see FIG. 1).

As shown in FIG. 8, the opening 21 provided in the central portion of the base portion 2 has a sufficiently larger lateral area than the input terminal 83 (see FIG. 19 or 20), and has a rectangular opening with the four corners thereof being formed with circular arcs. Moreover, a central portion of a longitudinal direction of the opening 21 is notched. In addition, the input terminal 83 passes through the opening 21 (see FIG. 19 or 20). In FIGS. 19 and 20, an opening lip of a form identical to the opening 21 of the base portion 2 is provided with the print substrate 1*p*, and the input terminal 83 is inserted toward the contact connecting portion 3 from the print substrate 1*p*.

In FIGS. 1 to 4, the pair of first lead portions 2*a* and 2*a* is higher than the bottom face of the base portion 2 by a step, and extends substantially parallel in a mutually opposing orientation. As shown in FIG. 7, the pair of first lead portions 2*a* and 2*a* is symmetric with respect to a line, and one portion of the first pair of wings of the bottom portion extends in a mutually opposing orientation (see FIG. 8).

A large portion of the first pair of wings of the base portion 2 is curved as the pair of first bending fragments 3*a* and 3*a* (see FIG. 1). The pair of first lead portions 2*a* and 2*a* and the pair of second lead portions 2*b* and 2*b* are placed so as to extend on three sides of the base portion 2, and the posture of the connector 1 is stabilized (see FIG. 8).

In FIGS. 1 to 4, the pair of first bending fragments 3*a* and 3*a* are curved as one portion of the first pair of wings of the base portion 2, and extend substantially parallel in a direction of insertion of the input terminal 83 (see FIG. 19). The pair of first bending fragments 3*a* and 3*a* extend to a height identical to the pair of third bending fragments 4*b* and 4*b* of a wide width to be described hereinafter, and allow the socket contact 10 to be of low profile.

As shown in FIG. 9, the pair of first inverted arms 3*b* and 3*b* is such that each wing of the pair of first bending fragments 3*a* and 3*a* is curved, and extends in a mutually approaching direction. In addition, the front end portions together of the pair of first inverted arms 3*b* and 3*b* are separated apart at a prescribed distance. The front end portions of the pair of first inverted arms 3*b* and 3*b* invert to an interior of the contact connecting portion 3.

As shown in FIG. 7 or 15, a central portion of the pair of first inverted arms 3*b* and 3*b* is open in a substantially rectangular shape, so that one wing of the pair of bending fragments 3*a* and 3*a* is easily curved. As described hereinafter, the connector 10 is formed by bending an expansion sheet 100 (see FIG. 16).

In FIG. 16, in a case that the pair of bending fragments 3*a* and 3*a* in an expansion sheet 100 is bent at a right angle at a pair of dies, by creating an opening in a central portion of the pair of first inverted arms 3*b* along a longitudinal direction, it is possible to make curved one wing of the pair of bending fragments of narrow width 3*a* and 3*a* without twisting.

In FIG. 9, the front end portions together of the pair of first inverted arms 3*b* and 3*b* are separated at a prescribed distance so as to touch one face of the input terminal 83 (see FIG. 19). The front end portions together of the pair of first inverted arms 3*b* and 3*b* are separated at a prescribed distance so as to be able to place the pair of second strip pieces 3*g* and 3*g* to be described hereinafter. In addition, the front end portions together of the pair of first inverted arms 3*b* and 3*b* extend toward a guiding face 3*f* along which another face of the input terminal 83 slides (see FIG. 19).

In FIGS. 1 to 4, in the pair of second bending fragments 3*c* and 3*c*, another of the second pair of wings of the base portion 2 is curved, and extends substantially parallel to a direction of insertion of the input terminal 83 (see FIG. 19). The pair of second inverted arms 3*d* and 3*d* extend from a front end of the pair of second bending fragments 3*c* and 3*c* to an interior of the contact connecting portion 3, and furthermore, invert toward an opening 21 provided in the base portion 2 (see FIG. 19). The front end face of the pair of second inverted arms 3*d* and 3*d* does not reach the bottom face of the base portion 2.

As shown in FIG. 12, the front end faces of the pair of first inverted arms 3*b* and 3*b* extend to the interior of the contact connecting portion 3, and are curved so as to draw circular arcs. These curved vertices can be set to be contact points 3*e* in contact with one face of the input terminal 83 (see FIG. 19). These contact points 3*e*, on an expansion sheet 100 prior to bend processing, may be hemispherical protrusions preformed on a front end face of the pair of first inverted arms (see FIG. 16).

Moreover, in FIGS. 1 to 4, on the pair of second inverted arms 3*d* and 3*d*, a guiding face 3*f* is provided such that another face of the input terminal 83 slides thereon (see FIG. 19). The pair of second inverted arms 3*d* and 3*d* are multiply bent and, by shortening a distance from a fixed end to a working end on which a load acts, when an external force operates (that is to say, when an input terminal 83 is inserted), deformations thereof can be ignored because the pair of second inverted arms 3*d* and 3*d* functions as a rigid body.

Moreover, in FIGS. 1 to 4, the connector 10 includes the pair of first strip pieces 4*a* and 4*a* and the pair of third bending fragments 4*b* and 4*b* of a wide width. As shown in FIG. 5, in the pair of first strip pieces 4*a* and 4*a*, both wings (sides) of the pair of second bending fragments 3*c* and 3*c* are curved to face oppositely. (See FIG. 10.)

As shown in FIG. 6, in the pair of third bending fragments 4*b* and 4*b*, the pair of first strip pieces 4*a* and 4*a* are curved and face the base portion 2 (see FIG. 11). In addition, an exterior face of the pair of third bending fragments 4*b* and 4*b* forms a vacuum-suction flat face. (See FIG. 1.)

Moreover, as shown in FIG. 10, the connector 10 includes the pair of second strip pieces 3*g* and 3*g*. In the pair of second strip pieces 3*g* and 3*g*, both wings of the pair of second inverted arms 3*d* and 3*d* are curved and face opposite each other (see FIGS. 3 and 9). The pair of second strip pieces 3*g* and 3*g* can restrict lateral movement of the input terminal 83 (see FIG. 19 or 20).

Moreover, in FIGS. 1 to 4, the connector 10 includes the fourth bending fragment 3*h* and the third inverted arm 3*j*. In the fourth bending fragment 3*h*, a central portion of the second pair of wings of the base portion 2 is curved, and extends substantially parallel in a direction of insertion of the input terminal 83 (see FIG. 20).

As shown in FIG. 14, the third inverted arm 3*j* extends from a front end of the fourth bending fragment 3*h* to the interior of the contact connecting portion 3, and inverts toward the opening 21. In addition, the third inverted arm 3*j* is placed between the pair of first inverted arms 3*b* and 3*b* (see FIG. 9), and when the input terminal 83 is inserted, can restrict a receding movement of the pair of first inverted arms 3*b* and 3*b* (see FIG. 19).

Moreover, in FIG. 4, the connector 10 includes a fourth inverted arm 3*k*. In the fourth inverted arm 3*k*, another of the pair of second wings of the base portion 2 is curved, and inverts to the interior of the contact connecting portion 3 (see FIG. 14). In addition, as shown in FIG. 14, the fourth inverted arm 3*k* faces the third inverted arm 3*j*.

For example, as shown in FIG. 18, the input terminal 83 has a hole 83*a* passing therethrough. In addition, as shown in FIG. 20, the front end portion of the fourth inverted arm 3*k* locks onto the hole 83*a* provided on the input terminal 83, and can prevent the input terminal 83 from falling out.

As shown in FIG. 16, the connector 10 is formed by bending the expansion sheet 100 such as of copper alloy that is expanded. In FIG. 16, the points indicated by dashed lines show bending regions of the expansion sheet 100, which are bent to an inner side or an outer side. In FIG. 16, symbols of components of the connector 10 after forming by bending the expansion sheet 100 are enclosed by parentheses.

As shown in FIG. 16, in the expansion sheet 100, the exterior, the opening 21, and the pair of openings 31 and 31 (see FIG. 7) are press-cut-processed beforehand. Next, the steps of the pair of first lead portions 2*a* and 2*a* and the pair of second lead portions 2*b* and 2*b* (see FIG. 1) are press-processed. Next, this expansion sheet 100 is formed by bending, and the connector 10 is manufactured (see FIG. 17).

In FIG. 16, the expansion sheet 100 is connected in a catenulate (chained) manner to a contact carrier 101. This kind of contact is usually called a "chained contact," and is of high productivity. The expansion sheet 100 is coupled to the contact carrier 101 with a V-shaped cut that is a notch 10*n*. In addition, in the connector 10, the notch 10*n* is bent, and is cut and separated from the contact carrier 101 (see FIG. 17).

Next, an operation of the connector 10 according to the present invention is explained.

In FIG. 12, in the connector 10, the pair of first inverted arms 3*b* and 3*b* and the pair of second inverted arms 3*d* and 3*d* are separated at a prescribed distance and placed opposite each other. It can also be said that the contact point 3*e* and the guiding face 3*f* are placed opposite each other at a distance less than or equal to the board thickness of the input terminal 83 (see FIG. 19).

As shown in FIG. 19, when the input terminal 83 is inserted into the opening 21 of the base unit 2, while another face of the input terminal 83 slides along the guiding face 3*f*, the pair of first inverted arms 3*b* and 3*b* is moved to the outer side. That is to say, the pair of first inverted arms 3*b* and 3*b* is elastically deformed, and can be bent. In addition, as a reaction to elastic deformation of the pair of first inverted arms 3*b* and 3*b*, the contact point 3*e* can provide a prescribed contact pressure to the input terminal 83.

In FIG. 20, by the front end portion of the fourth inverted arm 3*k* locking onto the hole 83*a* of the input terminal 83, it is possible to confirm an insertion position of the input terminal 83 by feel. By pulling out the input terminal 83 with a force strong enough to overcome the front end portion of the fourth inverted arm 3*k*, it is possible to disengage the input terminal 83 from the connector 10.

For example, it is possible to achieve a used state such as that shown in FIG. 18 for the connector 10. In FIG. 18, the pair of connectors 10 is surface-mounted to the print substrate 1*p*, which is a flexible substrate, by soldering. In FIG. 18, the connector 10 does not include a housing, but may be mounted on a print substrate by forming the expanded metallic sheet into a bare socket contact by multiply bending thereof, achieving a low-profile structure having high contact pressure, connectable to an extremely small input terminal 83.

The anode-cathode pitch of the pair of input terminals 83 shown in FIG. 18 has a large margin of manufacturing error, and when the pair of socket contacts (connectors 10) is fixed on the housing, removably detaching the pair of input terminals 83 becomes difficult. In FIG. 18, by surface-mounting the pair of socket contacts (connectors 10) on the print substrate 1*p*, which is a flexible substrate, it is possible to absorb the margin of manufacturing error of the anode-cathode pitch of the pair of input terminals 83, and removably detaching thereof can be done easily.

Moreover, as shown in FIG. 1, since the pair of first inverted arms 3*b* and 3*b* is configured to be separated at a prescribed distance, it is possible to distribute the margin of error of the contact force on the input terminal 83 (see FIG. 19). For example, solder plating is applied on the input terminal 83, which does not necessarily have a flat contact face, shown in FIG. 18. Since it is possible for the pair of first inverted arms 3*b* and 3*b* to move independently from the input terminal 83, which does not have a flat contact face, it is possible to distribute the margin of error of the contact force.

Furthermore, the connector 10 according to the present invention has a pair of first bending fragments 3*a* and 3*a* and a pair of first inverted arms 3*b* and 3*b* (see FIG. 1 to FIG. 4). By bending the first pair of wings of the base portion 2 to be substantially orthogonal, the same is reinforced against a bending moment of the base portion 2. It is also possible to call the pair of first bending fragments 3*a* and 3*a* "reinforcing ribs." Furthermore, since the pair of first inverted arms 3*b* and 3*b* are formed by inverting from the pair of first bending fragments 3*a* and 3*a*, the pair of first bending fragments 3*a* and 3*a* resist displacement of the pair of first inverted arms 3*b* and 3*b*. Therefore, there is the effect that strain on the socket contact is controlled.

In FIGS. 1 to 4, by the pair of third bending fragments 4*b* and 4*b* of a wide width covering both wings (sides) of the contact connecting portion 3, there is also the effect of protecting from unwanted forces applied thereto, such as falling objects.

For example, the connector 10 shown in FIG. 17 is separated by cutting from the contact carrier 101, and contained in the concave portions 62 formed in the carrier tape 6 (see FIG. 22). In FIG. 22, the main body 61 of the carrier tape 6 is composed of transparent strip-shaped plastic, and a plurality of concave portions 62 containing the connectors 10 are formed therein. The concave portions 62 are formed into a shape matching a contour of the connector 10, and the stances of the connectors 10 with exterior faces of the pair of third bending fragments 4*b* and 4*b* contained therein facing upward are stabilized. On one end portion of the main unit 61 of the carrier tape 6, sprocket holes 63 for transporting the carrier tape 6 are provided.

In FIG. 22, when transporting the carrier tape 6, the carrier tape 6 is wound into a roll shape, and the concave portions 62 are sealed with cover tape of long length (not shown). When removing the connector 10, the carrier tape 6 is flattened, and the cover tape is peeled off.

Since the exterior face of the pair of third bending fragments 4*b* and 4*b* forms a flat face capable of vacuum-suction, using an automatic mounting apparatus of the vacuum-suction method (not shown), extraction of the connector 10 becomes simple. Moreover, by using a carrier tape providing a series of concave portions 62 housing the connector 10, extraction of the connector 10 by an automatic mounting apparatus (vacuum-suction method) becomes simple. In this manner, the connector 10 according to the present invention has a structure preferable for an automatic mounting apparatus.

Moreover, the connector 10 according to the present invention includes a pair of second strip pieces 3*g* and 3*g* in which both wings of the pair of second inverted arms 3*d* and 3*d* are bent and face opposite each other, and the pair of second strip pieces 3*g* and 3*g* are structured to restrict lateral movement of the input terminal 83 (see FIGS. 9 and 19).

In FIGS. 9 to 11, the pair of second strip pieces 3*g* and 3*g* is separated at a prescribed distance, and is separated at a distance marginally broader than a width of the input terminal 83. In a case in which the input terminal 83 is correctly inserted into the opening 21, the input terminal 83 can pass between the pair of second strip pieces 3*g* and 3*g*. In a case in which the input terminal 83 is irregularly inserted into the opening 21, the input terminal 83 is blocked by the pair of second strip pieces 3*g* and 3*g*, and the input terminal 83 does not pass therethrough easily. In this manner, by the pair of second strip pieces 3*g* and 3*g* composing a protective barrier, it is possible to protect the input terminal 83 from irregular insertion.

Moreover, as shown in FIG. 9, the pair of second strip fragments 3*g* and 3*g* is placed in the interior of the front end portions of the pair of first inverted arms 3*b* and 3*b*, and also has the effect of preventing the front end portions together of the pair of first inverted arms 3*b* and 3*b* from unnecessarily spreading in opposing orientations.

Furthermore, in the connector 10 according to the present invention, since the third inverted arm 3*j* restricts excessive movement of the pair of first inverted arms 3*b* and 3*b*, it is possible to prevent elastic deformation exceeding the limit of elasticity of the pair of first inverted arms 3*b* and 3*b*. (See FIG. 9.)

Next, a configuration of a connector 20 according to another embodiment is explained. In FIG. 21, the connector 20 connects to a tabular tab-shaped contact (for example, the input terminal 83), and is mountable on a print substrate 1*p* having a plurality of through holes (not shown) (see FIGS. 1 and 19).

In FIG. 21, the connector 20 includes a substantially rectangular tabular base portion 2 and a contact connecting portion 3. The base portion 2 is provided on the print substrate 1*p* (see FIG. 1). The contact connecting portion 3 is provided on a central portion of the base portion 2, and connects to the tabular tab-shaped contact.

In FIG. 21, the base portion 2 has an opening 21 and a pair of first pins 5*a* and 5*a*. The opening 21 is provided on a central portion of the base portion 2, and the tab-shaped contact is passed therethrough. In the pair of first pins 5*a* and 5*a*, one portion of both first wings of the base portion 2 extends substantially parallel on an opposite side of the base portion 2, and is inserted into through holes on the print substrate 1*p* (see FIG. 1).

Moreover, in FIG. 21, the base portion 2 has pair of second pins 5*b* and 5*b*. The pair of second pins 5*b* and 5*b* is such that one portion of the second pair of wings substantially orthogonal to the first pair of wings of the base portion 2 extends substantially parallel on an opposite side of the base portion 2, and is inserted into the through holes of the print substrate 1*p* (see FIG. 1).

The contact connecting portion 3 has a pair of first bending fragments 3*a* and 3*a* and a pair of first inverted arms 3*b* and 3*b*. The pair of first bending fragments 3*a* and 3*a* is such that one portion of the first pair of wings of the base portion 2 is curved, and extends substantially parallel to a direction of insertion of the tab-shaped contact. The pair of first inverted arms 3*b* and 3*b* is such that each wing of the pair of first bending fragments 3*a* and 3*a* is curved and the arms extend in mutually approaching directions, while the front end portions thereof are placed apart from each other at a prescribed distance and invert toward an interior of the contact connecting portion 3. (See FIGS. 1 to 3, and 9.)

Moreover, in FIG. 21, the contact connecting portion 3 has a pair of second bending fragments 3*c* and 3*c* and a pair of second inverted arms 3*d* and 3*d*. (See FIG. 4.) The pair of second bending fragments 3*c* and 3*c* is such that another of the second pair of wings of the base unit 2 is curved, and extends substantially parallel to a direction of insertion of the tab-shaped contact (see FIG. 4). The pair of second inverted arms 3*d* and 3*d* extends from a front end of the pair of second bending fragments 3*c* and 3*c* to the interior of the contact connecting portion 3, and inverts toward the opening 21. (See FIG. 12.)

In addition, on the front end face of the pair of first inverted arms 3*b* and 3*b* is provided a contact point 3*e* in contact with one face of the tab-shaped contact. (See FIG. 12.) On the pair of second inverted arms 3*d* and 3*d*, a guiding face 3*f* such that another face of the tab-shaped contact slides is provided (see FIG. 12). In addition, other structures are identical to the connector 10, so explanations thereof have been omitted.

Next, an operation of the connector 20 according to another embodiment of the present invention is explained.

Here, a print substrate having a plurality of through holes applied to the connector 20 may preferably use a rigid plate, but a flexible plate is not excluded. "The socket contact to be mounted in the print substrate having the plurality of through holes" includes through hole mounting in which the pins are passed through the through holes, and the pins are soldered from the face opposite to mounting; and a non-soldered connection in which the pins are processed by press-fit termination, and this press fit termination is pressed into the through holes. Using an automatic mounting apparatus, it is possible to automate through hole mounting or a non-soldered connection.

In FIG. 21, the pair of first pins 5*a* and 5*a* and the pair of second pins 5*b* and 5*b* are preferably sufficiently separated, and the pair of first pins 5*a* and 5*a* and the pair of second pins 5*b* and 5*b* are preferably placed so as to extend on three sides of the base portion 2, thereby stabilizing the stance of the connector 20.

The connector 20 according to another embodiment of the present invention does not include a housing, and by being formed as a bare socket contact by multiply bending an expanded metallic sheet, the same may be mounted on a print substrate, achieving a low-profile structure having high contact pressure, connectable to an extremely small tab-shaped contact. In particular, it is preferable for the connector 20 to be used on a rigid substrate.

The socket contact according to the present invention may be provided on a flexible substrate, or may be provided on a rigid substrate. The socket contact according to the present invention achieves a low-profile structure connectable to an extremely small tab-shaped contact, and therefore can be mounted in compact electronic equipment for photographic use of recent years. In particular, the socket contact according to the present invention may be mounted onto a multi-branched foldable flexible substrate, and may be mounted onto compact electronic equipment for photographic use.

What is claimed is:

1. A socket contact that connects to a tabular tab-shaped contact and is mountable to a print substrate, the socket contact comprising:

a substantially rectangular tabular base portion that is disposed on the print substrate; and a contact connecting portion that is disposed in a central portion of the base portion and connects to the tab-shaped contact;

the base portion includes:

an opening provided in a central portion through which the tab-shaped contact passes;

a pair of first lead portions extending substantially parallel to the base portion in a mutually opposing orientation in a direction toward a first pair of wings and solderable to the print substrate; and a pair of second lead portions extending substantially parallel to the base portion from one of a second pair of wings orthogonal to the first pair of wings, and solderable to the print substrate;

the contact connecting portion includes:

a pair of first bending fragments such that one portion of the first pair of wings of the base portion is curved and extends substantially parallel in an insertion direction of the tab-shaped contact;

a pair of first inverted arms such that each one wing of the first bending fragments is curved, and the pair of first inverted arms extend in mutually approaching directions, while front end portions thereof are separated apart from each other at a prescribed distance and invert toward an interior of the contact connecting portion;

a pair of second bending fragments such that another of the second pair of wings of the base portion is curved and extends substantially parallel to the insertion direction of the tab-shaped contact; and a pair of second inverted arms extending from front ends of the pair of second bending fragments to the interior of the contact connecting portion, and inverted toward the opening, and wherein a contact point is provided on the front end face of the pair of first inverted arms to be in contact with one face of the tab-shaped contact; and a guiding face is provided on the pair of second inverted arms such that another face of the tab-shaped contact slides.

2. The socket contact according to claim 1, wherein the pair of first inverted arms has a central portion that is open so that one wing of the first pair of bending fragments is easily curved.

3. The socket contact according to claim 1, comprising:

a pair of first strip pieces in which both wings of the pair of second bending fragments are curved and face opposite each other; and a pair of third bending fragments that are wide in width in which the first strip pieces are curved and face toward the base portion, wherein an exterior face of the pair of third bending fragments forms a flat surface capable of vacuum adhesion.

4. The socket contact according to claim 1, comprising:

a pair of second strip pieces in which both wings of the pair of second inverted arms are curved and face opposite each other, wherein the pair of second inverted arms restricts lateral movement of the tab-shaped contact.

5. The socket contact according to claim 1, wherein an expanded metallic sheet is formed by bending.

6. A rigid substrate comprising the socket contact according to claim 1.

7. An electronic device comprising the socket contact according to claim 1.

8. The socket contact according to claim 1, comprising:

a fourth bending fragment such that a central portion at another of the second pair of wings of the base portion is curved and extends substantially parallel in the insertion direction of the tab-shaped contact; and a third inverted arm extending from a front end of the fourth bending fragment to the interior of the contact connecting portion and inverting toward the opening;

wherein the third inverted arm is placed between the pair of first inverted arms and restricts receding movement of the pair of first inverted arms when the tab-shaped contact is inserted.

9. The socket contact according to claim 8, comprising a fourth inverted arm such that another of the second pair of wings of the base portion is curved and inverts toward an interior of the contact connecting portion, and faces the third inverted arm;

wherein a front end portion of the fourth inverted arm locks into a hole provided on the tab-shaped contact, and prevents dropping of the tab-shaped contact.

10. A carrier tape providing a series of concave portions that house the socket contact according to claim 1.

11. An electronic device comprising the flexible substrate according to claim 10.

12. A flexible substrate comprising the socket contact according to claim 1.

13. An electronic device comprising the rigid substrate according to claim 12.

14. A socket contact that connects to a tabular tab-shaped contact, having a plurality of through holes, and being mountable on a print substrate, the socket contact comprising:

a substantially rectangular tabular base portion that is disposed on the print substrate; and a contact connecting portion that is disposed in a central portion of the base portion, connecting to the tab-shaped contact;

wherein the base portion includes:

an opening provided in a central portion through which the tab-shaped contact passes;

a pair of first pins in which parts of a first pair of wings extend substantially parallel to each other on an opposite side of the base portion and are inserted into the through holes; and a pair of second pins in which parts of one of a second pair of wings substantially orthogonal to the first pair of wings, extend substantially parallel to each other on an opposite side of the base portion and are inserted into the through holes;

wherein the contact connecting portion includes:

a pair of first bending fragments such that one portion of the first pair of wings of the base portion is curved and extends substantially parallel in an insertion direction of the tab-shaped contact;

a pair of first inverted arms such that each one wing of the first bending fragments is curved, and the pair of first inverted arms extend in mutually approaching directions, while front end portions thereof are separated apart from each other at a prescribed distance and invert toward an interior of the contact connecting portion;

a pair of second bending fragments such that another of the second pair of wings of the base portion is curved and extends substantially parallel to the insertion direction of the tab-shaped contact; and a pair of second inverted arms extending from front ends of the pair of second bending fragments to the interior of the contact connecting portion, and inverts toward the opening; and wherein a contact point is provided on a front end face of the pair of first inverted arms to be in contact with one face of the tab-shaped contact; and a guiding face is provided on the pair of second inverted arms such that another face of the tab-shaped contact slides thereon.

15. The socket contact according to claim 14, wherein the pair of first inverted arms has a central portion that is open so that one wing of the first pair of bending fragments is easily curved.

* * * * *